US012629798B2

(12) United States Patent
Liu et al.

(10) Patent No.: US 12,629,798 B2
(45) Date of Patent: May 19, 2026

(54) ABRASIVE ARTICLES AND METHOD OF MAKING THE SAME

(71) Applicant: 3M INNOVATIVE PROPERTIES COMPANY, St. Paul, MN (US)

(72) Inventors: Yuyang Liu, St. Paul, MN (US); Jing Zhang, Minneapolis, MN (US); Junting Li, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 623 days.

(21) Appl. No.: 18/018,158

(22) PCT Filed: Aug. 4, 2021

(86) PCT No.: PCT/IB2021/057167
§ 371 (c)(1),
(2) Date: Jan. 26, 2023

(87) PCT Pub. No.: WO2022/034443
PCT Pub. Date: Feb. 17, 2022

(65) Prior Publication Data

US 2023/0286111 A1 Sep. 14, 2023

Related U.S. Application Data

(60) Provisional application No. 63/063,472, filed on Aug. 10, 2020.

(51) Int. Cl.
*B24D 11/00* (2006.01)

(52) U.S. Cl.
CPC ..... *B24D 11/00* (2013.01); *B24D 11/001* (2013.01)

(58) Field of Classification Search
CPC ..... B24D 11/001; B24D 11/00
See application file for complete search history.

(56) References Cited

U.S. PATENT DOCUMENTS 1,910,444 A 5/1933 Nicholson
3,041,156 A 6/1962 Rowse et al.
(Continued)

FOREIGN PATENT DOCUMENTS

CN 306584111 S 6/2021
EP 1340588 A1 9/2003
(Continued)

OTHER PUBLICATIONS

International Search Report for PCT Application No. PCT/IB2021/057167, mailed on Nov. 9, 2021, 5 pages.

*Primary Examiner* — Pegah Parvini
(74) *Attorney, Agent, or Firm* — Melissa E. Buss

(57) ABSTRACT

An abrasive article comprises: a substrate comprising strands forming first void spaces between strands; a laminate joined to the substrate, wherein the laminate comprises a surface opposite to the substrate; a resin composition joined to the surface of the laminate. First and second portions of the surface of the laminate have respective first and second surface free energies that are different. Another abrasive article comprises: a substrate comprising strands forming first void spaces between strands; a laminate joined to the substrate, wherein the laminate comprises a first polymer and a second polymer; a resin composition joined to the laminate; In both embodiments, abrasive particles are joined to the resin composition, and a plurality of second void spaces extends through the laminate coinciding with first void spaces in the porous substrate. A method of making abrasive articles is also disclosed.

17 Claims, 10 Drawing Sheets

(56) References Cited

U.S. PATENT DOCUMENTS

| | | | | |
|---|---|---|---|---|
| 4,314,827 | A | 2/1982 | Leitheiser et al. | |
| 4,623,364 | A | 11/1986 | Cottringer et al. | |
| 4,652,275 | A | 3/1987 | Bloecher et al. | |
| 4,744,802 | A | 5/1988 | Schwabel | |
| 4,770,671 | A | 9/1988 | Monroe et al. | |
| 4,799,939 | A | 1/1989 | Bloecher et al. | |
| 4,881,951 | A | 11/1989 | Wood et al. | |
| 4,997,461 | A | 3/1991 | Markhoff-Matheny et al. | |
| 5,009,675 | A | 4/1991 | Kunz et al. | |
| 5,011,508 | A | 4/1991 | Wald et al. | |
| 5,015,266 | A | 5/1991 | Yamamoto | |
| 5,042,991 | A | 8/1991 | Kunz et al. | |
| 5,085,671 | A | 2/1992 | Martin et al. | |
| 5,152,917 | A | 10/1992 | Pieper et al. | |
| 5,201,916 | A | 4/1993 | Berg et al. | |
| 5,213,591 | A | 5/1993 | Celikkaya et al. | |
| 5,352,254 | A | 10/1994 | Celikkaya | |
| 5,366,523 | A | 11/1994 | Rowenshorst et al. | |
| 5,435,816 | A | 7/1995 | Spurgeon et al. | |
| 5,527,660 | A * | 6/1996 | Teng | B41M 5/38214 430/273.1 |
| 5,556,437 | A | 9/1996 | Lee et al. | |
| RE35,570 | E | 7/1997 | Rowenhorst et al. | |
| 5,672,097 | A | 9/1997 | Hoopman | |
| 5,946,991 | A | 9/1999 | Hoopman | |
| 5,975,987 | A | 11/1999 | Hoopman et al. | |
| 5,984,988 | A | 11/1999 | Berg et al. | |
| 6,129,540 | A | 10/2000 | Hoopman et al. | |
| 7,037,100 | B2 | 5/2006 | Strobel et al. | |
| 7,258,705 | B2 | 8/2007 | Woo et al. | |
| 8,034,137 | B2 | 10/2011 | Erickson et al. | |
| 8,142,531 | B2 | 3/2012 | Adefris et al. | |
| 8,142,532 | B2 | 3/2012 | Erickson et al. | |
| 8,142,891 | B2 | 3/2012 | Culler et al. | |
| 8,871,331 | B2 | 10/2014 | Seth | |
| 9,138,031 | B2 | 9/2015 | Wood et al. | |
| 9,168,636 | B2 | 10/2015 | Wald et al. | |
| 9,771,504 | B2 | 9/2017 | Adefris | |
| 2002/0182955 | A1 | 12/2002 | Weglewski et al. | |
| 2006/0264574 | A1 * | 11/2006 | Bieser | C08L 23/10 525/191 |
| 2007/0028525 | A1 * | 2/2007 | Woo | B24D 11/02 451/526 |
| 2007/0178280 | A1 | 8/2007 | Bower et al. | |
| 2009/0165394 | A1 | 7/2009 | Culler et al. | |
| 2009/0169816 | A1 | 7/2009 | Erickson et al. | |
| 2009/0325466 | A1 * | 12/2009 | Kincaid | B24D 3/20 451/28 |
| 2011/0065362 | A1 | 3/2011 | Woo et al. | |
| 2012/0227333 | A1 | 9/2012 | Adefris et al. | |
| 2013/0040537 | A1 | 2/2013 | Schwabel et al. | |
| 2013/0125477 | A1 | 5/2013 | Adefris | |
| 2015/0004889 | A1 | 1/2015 | Set | |
| 2015/0126098 | A1 | 5/2015 | Eilers et al. | |
| 2015/0267097 | A1 | 9/2015 | Rosenflanz et al. | |
| 2016/0009048 | A1 | 1/2016 | Slama et al. | |
| 2019/0275641 | A1 | 9/2019 | Nienaber et al. | |
| 2020/0157302 | A1 | 5/2020 | Jing et al. | |
| 2020/0298373 | A1 | 9/2020 | Annen et al. | |

FOREIGN PATENT DOCUMENTS

| | | | | |
|---|---|---|---|---|
| EP | 1464444 | A1 | 10/2004 | |
| EP | 3441185 | A1 | 2/2019 | |
| JP | 2005-256226 | * | 9/2009 | D06M 15/56 |
| WO | 2012112305 | A2 | 8/2012 | |
| WO | 2015100018 | A1 | 7/2015 | |
| WO | 2015100020 | A1 | 7/2015 | |
| WO | 2015100220 | A1 | 7/2015 | |
| WO | 2016028683 | A1 | 2/2016 | |
| WO | 2016089675 | A1 | 6/2016 | |
| WO | 2016205133 | A1 | 12/2016 | |
| WO | 2016205267 | A1 | 12/2016 | |
| WO | 2017007703 | A1 | 1/2017 | |
| WO | 2017007714 | A1 | 1/2017 | |
| WO | 2017066077 | A1 | 4/2017 | |
| WO | 2018063958 | A1 | 4/2018 | |
| WO | 2018063960 | A1 | 4/2018 | |
| WO | 2018063962 | A1 | 4/2018 | |
| WO | 2018080703 | A1 | 5/2018 | |
| WO | 2018080704 | A1 | 5/2018 | |
| WO | 2018080705 | A1 | 5/2018 | |
| WO | 2018080755 | A1 | 5/2018 | |
| WO | 2018080756 | A1 | 5/2018 | |
| WO | 2018080765 | A1 | 5/2018 | |
| WO | 2018080784 | A1 | 5/2018 | |
| WO | 2018080799 | A1 | 5/2018 | |
| WO | 2018118688 | A1 | 6/2018 | |
| WO | 2018118690 | A1 | 6/2018 | |
| WO | 2018118699 | A1 | 6/2018 | |
| WO | 2018134732 | A1 | 7/2018 | |
| WO | 2018136268 | A1 | 7/2018 | |
| WO | 2018136269 | A1 | 7/2018 | |
| WO | 2018136271 | A1 | 7/2018 | |
| WO | 2019102312 | A1 | 5/2019 | |
| WO | 2019102328 | A1 | 5/2019 | |
| WO | 2019102329 | A1 | 5/2019 | |
| WO | 2019102330 | A1 | 5/2019 | |
| WO | 2019102331 | A1 | 5/2019 | |
| WO | 2019102332 | A1 | 5/2019 | |
| WO | 2019111212 | A1 | 6/2019 | |
| WO | 2020021457 | A1 | 1/2020 | |
| WO | 2020084483 | A1 | 4/2020 | |
| WO | 2020099969 | A1 | 5/2020 | |
| WO | 2020100084 | A1 | 5/2020 | |
| WO | 2020128716 | A1 | 6/2020 | |
| WO | 2020128717 | A1 | 6/2020 | |
| WO | 2020128719 | A1 | 6/2020 | |
| WO | 2020128720 | A2 | 6/2020 | |
| WO | 2020128752 | A1 | 6/2020 | |
| WO | 2020128833 | A1 | 6/2020 | |
| WO | 2020128838 | A1 | 6/2020 | |
| WO | 2020128842 | A1 | 6/2020 | |
| WO | 2020128844 | A1 | 6/2020 | |
| WO | 2020128845 | A1 | 6/2020 | |
| WO | 2020128852 | A1 | 6/2020 | |
| WO | 2020128853 | A1 | 6/2020 | |
| WO | 2020128854 | A1 | 6/2020 | |
| WO | 2020128857 | A1 | 6/2020 | |
| WO | 2020165683 | A1 | 8/2020 | |
| WO | 2020165709 | A1 | 8/2020 | |
| WO | 2021111327 | A1 | 6/2021 | |
| WO | 2021116882 | A1 | 6/2021 | |
| WO | 2021116883 | A1 | 6/2021 | |
| WO | 2021137092 | A1 | 7/2021 | |
| WO | 2021186326 | A1 | 9/2021 | |
| WO | 2021198951 | A1 | 10/2021 | |
| WO | 2021234494 | A1 | 11/2021 | |
| WO | 2021234540 | A1 | 11/2021 | |
| WO | 2022023845 | A1 | 2/2022 | |

* cited by examiner

ABRASIVE ARTICLES AND METHOD OF MAKING THE SAME

CROSS REFERENCE TO RELATED APPLICATIONS

This application is a national stage filing under 35 U.S.C. 371 of PCT/IB2021/057167, filed Aug. 4, 2021, which claims the benefit of U.S. Provisional Application No. 63/063,472 filed Aug. 10, 2020, the disclosures of which are incorporated by reference in their entireties herein.

BACKGROUND

It is very common for dry sanding operations to generate a significant amount of airborne dust. To minimize this airborne dust, it is common to use abrasive discs on a tool while vacuum is drawn through the abrasive disc, from the abrasive side through the backside of the disc, and into a dust-collection system. For this purpose, many abrasives are available with holes converted into them.

SUMMARY

There is a continuing need for abrasive articles that provide enhanced cut and/or useful abrading life while demonstrating superior dust extraction. The present disclosure provides such abrasive articles. Advantageously, abrasive articles according to the present disclosure provide dust-extraction benefits of an abrasive with a porous construction, but also provides superior abrasive performance such as cut, surface finish and/or useful abrading life.

In one aspect, the present disclosure provides an abrasive article comprising:

a substrate comprising strands forming first void spaces between strands;

a laminate joined to the substrate, wherein the laminate comprises a surface opposite to the substrate;

a resin composition joined to the surface of the laminate, wherein a first portion of the surface of the laminate has a first surface free energy, wherein a second portion of the surface of the laminate has a second surface free energy, and wherein the first surface free energy is different from the second surface free energy; and abrasive particles joined to the resin composition, wherein a plurality of second void spaces extends through the laminate coinciding with first void spaces in the porous substrate.

In another aspect, the present disclosure provides an abrasive article comprising:

a substrate comprising strands forming first void spaces between strands;

a laminate joined to the substrate, wherein the laminate comprises a first polymer and a second polymer;

a resin composition joined to the laminate; and abrasive particles joined to the resin composition, wherein a plurality of second void spaces extends through the laminate coinciding with first void spaces in the porous substrate.

In yet another aspect, the present disclosure provides a method of making an abrasive article, the method comprising:

joining a laminate to a porous substrate, wherein the porous substrate comprises strands forming first void spaces between the strands, and wherein the laminate comprises a first polymer and a second polymer;

joining a curable resin composition to the laminate opposite the porous substrate;

joining abrasive particles to the curable resin composition; and forming a plurality of second void spaces extending through the laminate coinciding with first void spaces in the porous substrate.

As used herein:

The term "surface free energy" refers to a quantitative measure of the surface tension of a solid, caused by intermolecular interactions at an interface, such as London dispersive force, Debye inductive force, Keesom orientational forces, hydrogen bonding, Lewis acid—base interactions, and energetically homogeneous and heterogeneous interactions.

The term "portion" refers to a part of a whole. A portion can be a section, a plurality of areas, or a set of sections that having localized properties.

The term "hydrophobic" describes an observed tendency of substances to aggregate in an aqueous medium and exclude water molecules. The hydrophobic effect can describe the segregation of water, which maximizes hydrogen bonding between molecules of water and minimizes the area of contact between water and nonpolar molecules. If a water droplet on a surface of a material has a static contact angle of more than 90 degrees, the surface of the material is considered hydrophobic.

The term "hydrophilic" describes an observed tendency of substances to mix with, dissolve in, or be wet by water. Interactions of a hydrophilic molecule, or part of a molecule, with water and other polar substances are more thermodynamically favorable than their interactions with oil or other hydrophobic substances. If a water droplet on a surface of a material has a static contact angle of less than or equal to 90 degrees, preferably less than 60 degrees, and more preferably less than 20 degrees, the surface of the material is considered hydrophilic.

The term "ambient conditions" refers to a temperature of 20 degrees Celsius (293.15 Kelvins, 68 degrees Fahrenheit) and an absolute pressure of 1 Standard atmospheric pressure (1 atm, 101.3 kilopascals).

Features and advantages of the present disclosure will be further understood upon consideration of the detailed description as well as the appended claims.

BRIEF DESCRIPTION OF THE DRAWINGS

The drawings illustrate generally, by way of example, but not by way of limitation, various embodiments discussed in the present document.

Figure 1:
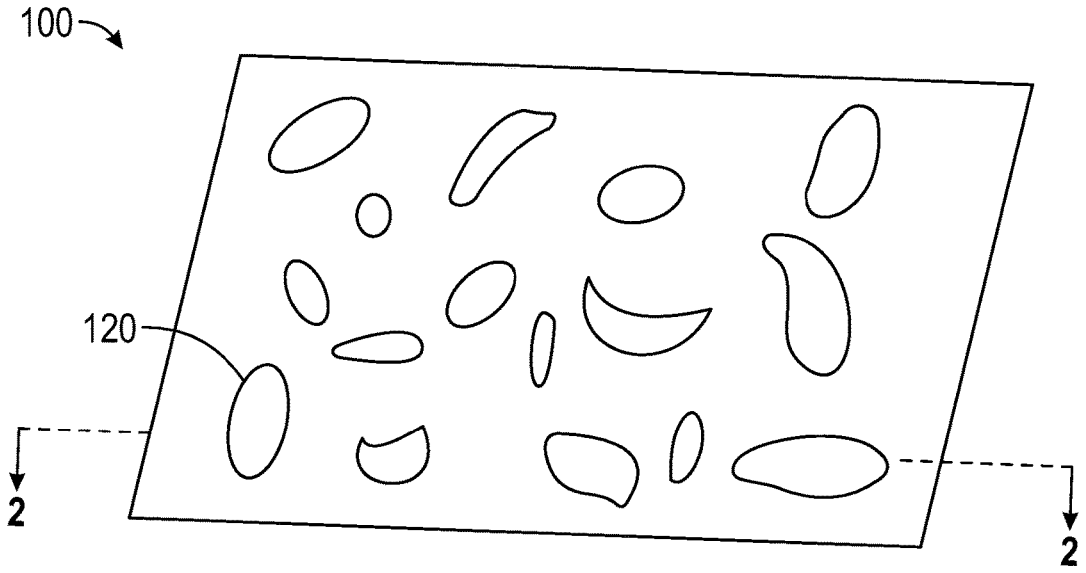
FIG. 1 is a schematic perspective view of exemplary abrasive article 100 according to one embodiment of the present disclosure.

Repeated use of reference characters in the specification and drawings is intended to represent the same or analogous features or elements of the disclosure. It should be understood that numerous other modifications and embodiments can be devised by those skilled in the art, which fall within the scope and spirit of the principles of the disclosure. The figures may not be drawn to scale.

DETAILED DESCRIPTION

Embodiments described herein are directed to abrasive articles that have the dust-extraction advantages of an abrasive on a net-type backing, but also provides superior abrasive performance (cut, surface finish and/or useful abrading life) advantages of a conventional abrasive.

This combination of benefits is possible because the construction of the abrasive articles described herein allows for a non-coextensive abrasive coating on a porous backing to form patterned areas of abrasive coating as well as open areas devoid of any abrasive coating. The abrasive area can be randomly and sporadically distributed across the abrasive article, or according to a predetermined pattern. The abrasive area can be designed independently of any abrasive layer pattern present on the porous substrate, optimizing both abrasive performance and dust extraction.

Embodiments herein also apply to method of making abrasive articles, particularly mesh-type backed abrasive articles.

Figure 2:
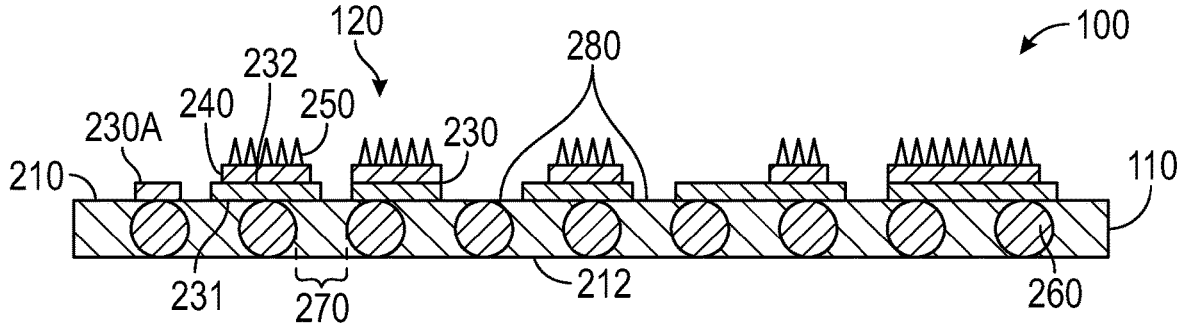
FIG. 2 is a schematic cross-sectional side view of abrasive article 100 in FIG. 1 taken on the line 2-2.

Referring now to FIGS. 1 and 2, the abrasive article 100 includes a porous substrate 110 comprising strands forming first void spaces 270 between the strands (see FIG. 2). Abrasive element 120 comprises cured resin 240 and abrasive particles 250 attached to cured resin 240. Abrasive element 120 is joined to porous substrate 110. A plurality of void spaces extends through the porous substrate 110 adjacent to and/or between abrasive element(s) 120.

The plurality of void spaces coinciding with void spaces in the porous substrate 110 allow for an air flow through the article 100 during normal use at a rate of, e.g., at least 0.1 L/s (e.g., at least 0.2 L/s, at least 0.4 L/s, at least 0.6 L/s, at least 1 L/s; or about 0.1 L/s to about 1 L/s, about 0.25 L/s to about 0.75 L/s, about 0.5 L/s to about 1 L/s, about 1 L/s to about 2 L/s, about 1.5 L/s or about 3 L/s), such that, when in use, dust can be removed from an abraded surface through the abrasive article.

Referring to FIG. 2, abrasive article 100 includes a porous substrate 110 comprising strands 260 forming first void spaces 270. Laminate 230 is joined to porous substrate 110 through first surface 231 of laminate 230. Cured make resin 240 is joined to laminate 230 opposite porous substrate 110 through second surface 232. Abrasive particles 250 are joined to make resin 240. A plurality of second void spaces 280 extends through the laminate coinciding with first void spaces 270.

In some instances, the abrasive article comprises laminate 230A, which does not comprise a cured make resin joined to laminate 230A.

In some embodiments, the abrasive particles are at least partially embedded in the cured resin composition. As used herein, the term "at least partially embedded" generally means that at least a portion of an abrasive particle is embedded in the cured resin composition, such that, the abrasive particle is anchored in the cured resin composition. In some embodiments, abrasive particles are coated onto the laminate together in the form of a slurry composition.

Figure 3:
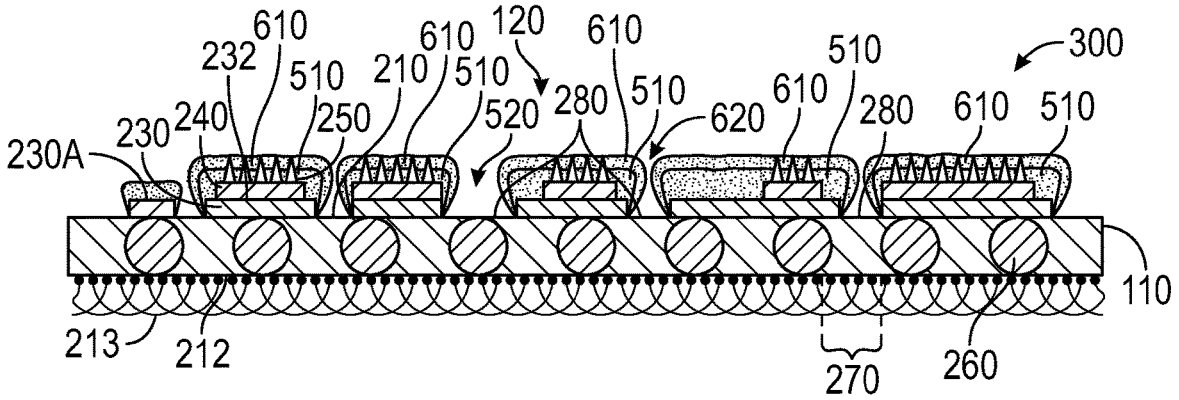
FIG. 3 is a schematic side cross-sectional view of exemplary abrasive article 300 according to various embodiments of the present disclosure.
Figure 4A:
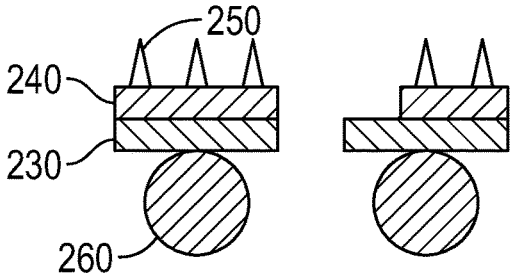
FIGS. 4A-4K are side cross-sectional views of exemplary portions of various abrasive articles according to various embodiments of the present disclosure.
Figure 4B:
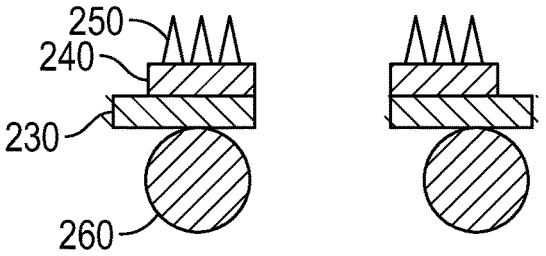
Figure 4C:
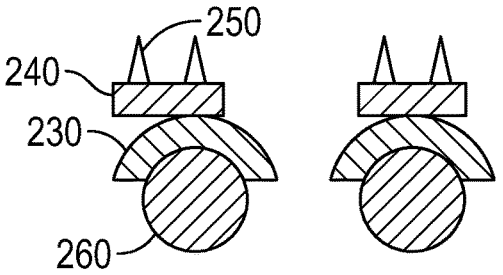
Figure 4D:
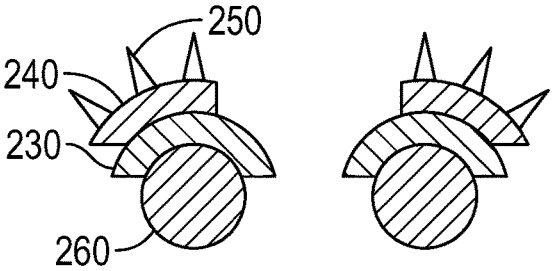
Figure 4E:
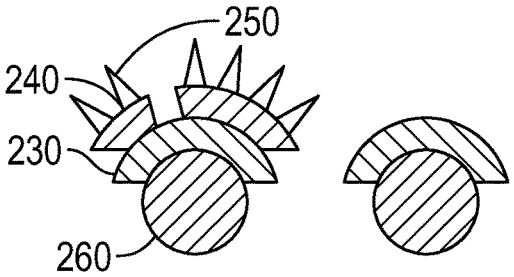
Figure 4F:
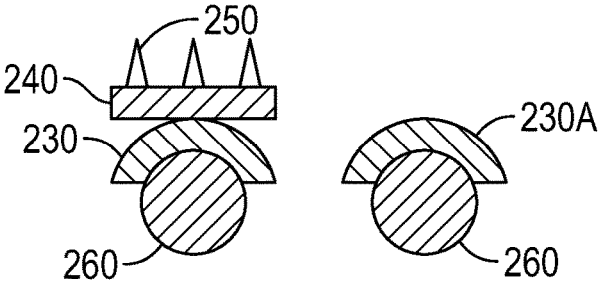
Figure 4G:
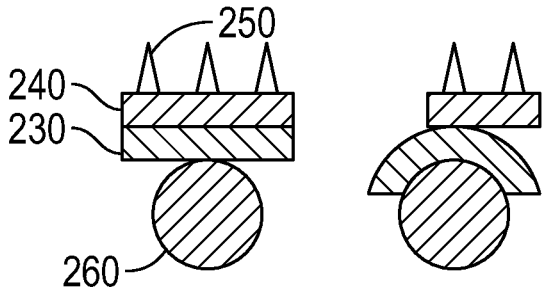
Figure 4H:
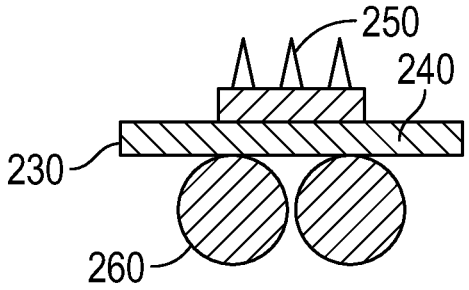
Figure 4I:
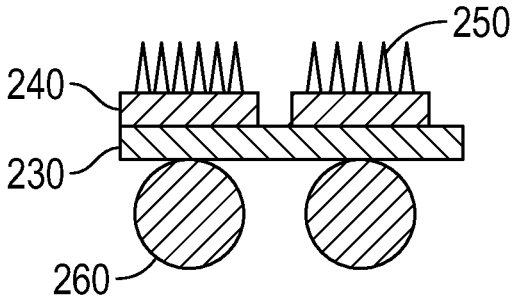
Figure 4J:
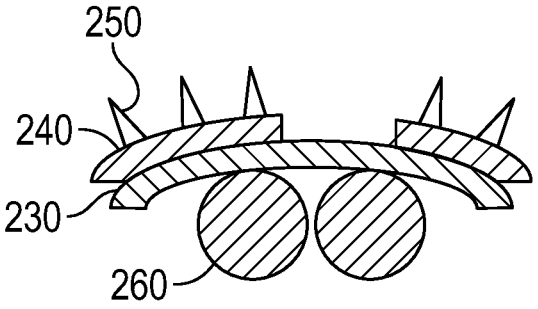
Figure 4K:
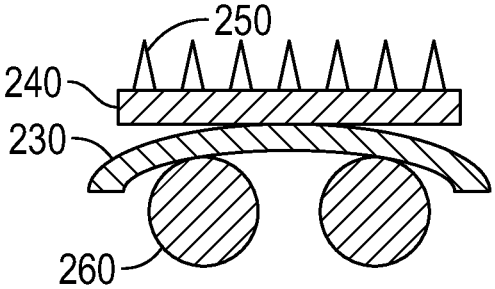

Referring now to FIG. 3, abrasive article 200 incorporates all of the features shown in FIG. 2, which will not be discussed again for the sake of brevity. Abrasive article 200 comprises first side 210 joined to laminate 230. Second side 212 is opposite first side 210. In some embodiments, the second side 212 can include at least a part of an attachment system 213. In some embodiments, the attachment system 213 can be a two-part mechanical fastening system. For example, FIG. 3 depicts a loop layer of a two-part hook and loop attachment system. In some embodiments, abrasive article 200 also include size layer 510 having size layer void spaces 520, which coincide with second void spaces 280. In some embodiments, abrasive article 200 also includes optional supersize layer 610 overlaying size layer 510. The optional supersize layer 610 has supersize layer void spaces 620, which coincide with size coat void spaces 520 and second void spaces 280.

The layer configurations described herein are not intended to be exhaustive, and it is to be understood that layers can be added or removed with respect to any of the examples depicted in FIGS. 1-3. It should also be understood that abrasive articles could take any form, for example, circular discs, sheets or belts.

FIGS. 4A-4K show the various embodiments (not exhaustive) of the possible structures of the laminate 230, cured resin composition 240, abrasive particles 250, and strands 260. For example, the laminate 230 can at least partially wrap around the strands 260 to create second void spaces 280. And in some instances, the laminate 230 can wrap around some stands 260 and not others. In various instances, the laminate 230 can be at least partially covered by cured resin composition 240, or may not be covered by cured resin composition 240.

The abrasive articles of the various embodiments described herein include a porous substrate. The porous substrate may be constructed from any of a number of materials known in the art for making coated abrasive articles. Although not necessarily so limited, porous substrate 110 can have a thickness of at least 0.02 millimeters, at least 0.03 millimeters, 0.05 millimeters, 0.07 millimeters, or 0.1 millimeters. The backing could have a thickness of up to 5 millimeters, up to 4 millimeters, up to 2.5 millimeters, up to 1.5 millimeters, or up to 0.4 millimeters.

The porous substrate can be flexible and has voids spaces (e.g., void spaces between strands) such that it is porous. Flexible materials from which the porous substrate can be made include cloth (e.g., cloth made from fibers or yarns comprising polyester, nylon, silk, cotton, and/or rayon, which may be woven, knit or stitch bonded) and scrim. The porous substrate can comprise a loop backing.

Exemplary porous substrates include knit fabrics (e.g., knit fabrics having a volume porosity of at least 20 percent, at least 30 percent, at least 40 percent, at least 50 percent, at least 60 percent, or even at least 70 percent), open weave fabrics, woven meshes/screens (e.g., wire mesh or fiberglass mesh), porous nonwoven fabrics, unitary meshes (e.g., unitary continuous plastic screens), perforated polymeric films, and perforated nonporous (e.g., sealed) fabrics. In some embodiments, the porous substrate may comprise an integral loop substrate, especially in the case of knit fabrics.

Porous fabric substrates can be made from any known fibers, whether natural, synthetic, or a blend of natural and synthetic fibers. Examples of useful fiber materials include fibers or yarns comprising polyester (e.g., polyethylene terephthalate), polyamide (e.g., hexamethylene adipamide, polycaprolactam), polypropylene, acrylic, cellulose acetate, polyvinylidene chloride-vinyl chloride copolymers, vinyl chloride-acrylonitrile copolymers, graphite, polyimide, silk, cotton, linen, jute, hemp, and/or rayon. Useful fibers may be of virgin materials or of recycled or waste materials reclaimed from garment cuttings, carpet manufacturing, fiber manufacturing, or textile processing, for example. Useful fibers may be homogenous or a composite such as a bicomponent fiber (for example, a co-spun sheath-core fiber). The fibers may be tensilized and crimped, but may also be continuous filaments such as those formed by an extrusion process.

Porous film substrates may comprise perforated polymer films comprising, for example, polyester (e.g., polyethylene terephthalate), polyamide (e.g., hexamethylene adipamide, polycaprolactam), polypropylene, acrylic, cellulose acetate, polyvinylidene chloride-vinyl chloride copolymers, and/or vinyl chloride-acrylonitrile copolymers. Perforation may be provided by die punching, needle punching, knife cutting, laser perforating, and slitting as described in U.S. Pat. No. 9,168,636 (Wald et al.) and U.S. Pat. No. 9,138,031 (Wood et al.), for example. Perforation may also be provided by applying a flame, a heat source, or pressurized fluid, as described in U.S. Patent Application No 2016/0009048 A1 (Slama et al.) and U.S. Pat. No. 7,037,100 (Strobel et al.), for example.

The porous substrate can be rigid, semi-rigid, or flexible. The porous substrate has openings that extend through its body between two opposed major surfaces. The openings may be perforations or spaces between fiber strands of a porous, for example.

The openings in the porous substrate should be of sufficient size, which may be the same or different, that swarf generated during abrading operations can be drawn by vacuum through the openings and away from the surface of a workpiece being abraded. In some embodiments, the openings are of sufficient size that some or all of them allow passage of swarf particles with an average diameter of less than or equal to 0.01 millimeter (mm), less than or equal to 0.05 mm, less than or equal to 0.1 mm, less than or equal to 0.15 mm, less than or equal to 0.3 mm, less than or equal to 0.5 mm, less than or equal to 1 mm, or even less than or equal to 2 mm through the porous substrate.

The porous substrate can have a thickness of at least 0.02 mm, at least 0.03 mm, at least 0.05 mm, at least 0.07 mm, or even at least 0.1 mm, although this is not a requirement. Likewise, the porous substrate may have a thickness of up to 5 mm, up to 4 mm, up to 2.5 mm, up to 1.5 mm, or up to 0.4 mm in any combination with the preceding lower limits, although this is not a requirement.

Generally, the strength of the porous substrate should be sufficient to resist tearing or other damage during abrading processes. The thickness and smoothness of the porous substrate should also be suitable to provide the desired thickness and smoothness of the abrasive article; for example, depending on the intended application or use of the abrasive article.

The porous substrate may have any basis weight; for example, in a range of from 25 to 1000 grams per square meter (gsm), more typically 50 to 600 gsm, and even more typically 100 to 300 gsm. To promote adhesion of the functional layer to the porous substrate, one or more surfaces of the porous substrate may be modified by known methods including corona discharge, ultraviolet light exposure, electron beam exposure, flame discharge, and/or scuffing.

In some embodiments, the porous substrate may be treated using, e.g., chemical treatment, corona treatment such as air or nitrogen corona, plasma, flame, or actinic radiation. The benefit of the treatment can be, for example, enhancing adhesion between the backing and an applied layer, such as a make layer or a laminate. It is expressly contemplated that such pretreatments can also be applied to a backing layer of abrasive articles described herein in addition to, or prior to, application of a laminate. Some examples of substrate treatments are described in commonly-owned pending PCT Pat. Appl. Publ. No. WO2020/021457 (Koenig et al.), and U.S. Pat. Appl. No. 62/991,097.

The nature of the laminate is also non-limiting. Generally speaking, the laminate can be in any form (e.g., a nonwoven or woven web or a film) that provides a substantially flat landing for uncured (or partially cured) resin composition, such that uncured resin composition that is deposited on the laminate 230 remains on the surface and does not have an opportunity to, for example, move into the void spaces 270 between strands 260 of porous substrate 110; but at the same time migrates away from the void spaces 270 between strands 260, for example, during the curing process that forms cured resin composition 240, thereby opening a plurality of second void spaces 280 extending through the laminate coinciding with first void spaces 270.

The laminate may be provided, for example, in the form of a continuous non-apertured sheet, or as a continuous apertured sheet whereby apertures are provided in areas adjacent to or surrounding the abrasive element(s). In either case, the laminate provides a substantially flat landing for uncured (or partially cured) resin composition. The laminate 230 used herein may be opaque or transparent or translucent to visible light. They may be flexible or inflexible. For example, the laminate 230 may be a flexible sheet made using conventional filmmaking techniques such as extrusion of a laminate resin into a sheet and optional uniaxial or biaxial orientation.

The laminate 230 in this disclosure includes a second surface 232, where a make resin 240 joined to and generally opposite to a first surface 231 of the laminate 230. The second surface 232 comprises at least two portions having different surface free energies. For example, a first portion of the surface of the laminate has a first surface free energy, a second portion of the surface of the laminate has a second surface free energy, and the first surface free energy is different from the second surface free energy. In some embodiments, each of the first portion and the second portion can comprise a plurality of discrete surface areas. In some other embodiments, each of the first portion and the second portion can comprise interconnected surface sections. In some embodiments, the first portion and the second portion can be arrayed in at least one pattern on the second surface 232. In some of these embodiments, the pattern can be predetermined or controlled.

Surface free energy is commonly calculated through contact angle measurements using known measurement methods. A static contact angle is the angle that connects the solid-liquid interface and the liquid-gas interface when the contact area between liquid and solid is not changed from the outside during the measurement. In these methods, the static contact angle of a surface is measured with liquids, such as water-based liquids or organic solvent-based liquids, usually by a static contact angle meter. For example, surface free energy can be obtained according to ASTM D 5725-(99) (Reapproved 2003) "Standard Test Method for Surface Wettability and Absorbency of Sheeted Materials Using an Automated Contact Angle Tester", ASTM International, West Conshohocken, Pennsylvannia. Static contact angle measurement gives an indication on how a liquid wet the surface. At ambient conditions, when a static contact angle is smaller than 90 degree, high wetting occurs, while when a static contact angle is larger than 90 degree but less than 180 degree, low wetting occurs. When a static contact angle is 180 degree, it is considered the surface is not wetted as all. Surfaces with high surface free energy are more easily wetted than surfaces with low surface free energy.

The surface free energies of various portions of laminate surface are typically different. In some embodiments, the difference of between surface free energies of two different portions can be at least about 0.5 millinewton per meter (mN/m), 0.6 mN/m, 0.7 mN/m, 0.8 mN/m, 1 mN/m, 1.5 mN/m, 2 mN/m, 2.5 mN/m, 3 mN/m, and preferably about 5 mN/m, 5.5 mN/m, 6 mN/m, 7 mN/m, 8 mN/m, 10 mN/m, 11 mN/m, 12 mN/m, 13 mN/m, 14 mN/m 15 mN/m, or even at least about 20 mN/m at ambient conditions.

Suitable materials for the laminate can be non-limiting. A variety of laminate materials that include an organic polymer can be used herein. The entire laminate may be made of organic polymer materials, or the laminate may have a surface of such polymer materials. Whether just on a surface of a laminate or forming the entire laminate, the laminate materials provide phases of separation on the surface, resulting in portions with localized properties, such as surface free energies. In various embodiments, the laminate comprises hot-melt materials, for example, polyester hot-melt materials (e.g., PE85 Polyester Hot Melt Web Adhesive available from Bostik, Wauwatosa, Wisconsin). In many embodiments, the laminate comprises at least two different polymers, i.e., a first polymer and a second polymer. A first portion of the surface with a first surface free energy is formed of the first polymer, a second portion of the surface with a second surface free energy is formed of the second polymer. In some embodiments, the laminate comprises three or more laminate materials, forming additional portions with different second surface free energies.

The terms "polymer" and "polymer material" include, but are not limited to, organic homopolymers, copolymers, such as for example, block, graft, random, and copolymers, terpolymers, etc., and blends and modifications thereof. Furthermore, unless otherwise specifically limited, the term "polymer" shall include all possible geometrical configurations of the material. These configurations include, but are not limited to, isotactic, syndiotactic, and atactic symmetries.

A variety of polymer materials can be used herein. In one embodiment, the laminate comprises a hot-melt polymer. Examples include polyamides, polyesters, poly(ethylene-acrylic acid) copolymers, poly(ethylene-acrylate) copolymers, poly(ethylene-methyl acetate) copolymers, polyolefins, polyurethane-polyethylene-vinyl acetate terpolymers, polyethylene acrylate copolymers, ethylene methacrylic acid copolymers, acid-modified ethylene terpolymers, anhydride-modified ethylene acylates, vinyl acetate polymer, and combinations thereof. The laminate may also contain an additive, such as ethyl acetoacetate. In one embodiment, the laminate contains at least 5% ethyl acetoacetate.

In one embodiment, the laminate material has a melting temperature between about 50° C. to about 150° C. In another embodiment the laminate material has a melting temperature between about 80° C. to about 110° C.

In many embodiments, the laminate comprises hydrophobic or hydrophilic polymer materials. In some embodiments, the laminate comprises both hydrophobic and hydrophilic polymers.

Illustrative examples of suitable (hydrophobic) materials include organic polymers such as polyesters (such as polyethylene terephthalate, polybutylene terephthalate, polycarbonates, allyl diglycol carbonate, polyacrylates (e.g., polymethyl methacrylate), polystyrenes, polyvinyl chlorides, polysulfones, polyethersulfones, polyphenylethersulfones, polyethers, epoxy addition polymers with polydiamines or polydithiols, polyolefins (polypropylene, polyethylene, and polyethylene copolymers), fluorinated polymers (e.g., tetrafluoroethylene/hexafluoropropylene/vinylidene fluoride terpolymers, polyvinylidene fluorides, and polyvinyl fluorides), and cellulose esters (e.g., cellulose acetates or cellulose butyrates), and combinations thereof (e.g., including blends and laminates thereof). A preferred material comprises polyethylene terephthalate.

Illustrative examples of other suitable (more hydrophilic) materials include organic polymers such as homopolymers and copolymers of N-isopropylacrylamide homopolymers and copolymers (e.g., poly(N-isopropylacrylamide-co-butyl acrylate) and poly(N-isopropylacrylamide-co-methacrylic acid)), polyacrylamide and copolymers (such as poly(acrylamide-co-acrylic acid)), polyoxazolines (e.g., poly(-methyl-2-oxazoline) and poly(-ethyl-2-oxazoline)), polyamides, homopolymers and copolymers of poly(acrylic acid) (e.g., poly(acrylic acid-co-maleic acid)), poly(methacrylic acid) copolymers (e.g., poly(N-isopropylacrylamide-co-methacrylic acid)), polymethacrylates (e.g., poly(hydroxypropyl methacrylate)), homopolymers and copolymers of ethylene glycol (e.g., polyethylene glycol, polyethylene-block-poly(ethylene glycol) and poly(ethylene glycol)-block-polypropylene glycol)-block-poly(ethylene glycol)), poly(vinyl alcohol) and related copolymers (such as poly (vinyl alcohol-co-ethylene)), poly(vinyl pyrrolidinone) and copolymers (e.g., poly(l-vinylpyrrolidone-co-styrene) and poly(l-vinylpyrrolidone-co-vinyl acetate)), maleic anhydride copolymers (e.g., poly(ethylene-alt-maleic anhydride)), polyether (such as poly(methyl vinyl ether)) and copolymers (e.g., poly(methyl vinyl ether-alt-maleic acid)).

The surface of the laminate can also comprise a superhydrophilic portion in some embodiments. A superhydrophilic surface is defined as having a static contact angle of water of 15 degrees or less under ambient conditions. In these embodiments, the laminate can comprise suitable superhydrophilic materials prepared from compositions that include one or more compounds with hydrophilic-functional group(s). The hydrophilic groups render hydrophilicity to the surface. Suitable hydrophilic functional groups may include sulfonate groups, sulfate groups, phosphate groups, phosphonate groups, carboxylate groups, gluconamide-containing groups, sugar-containing groups, polyvinyl alcohol-containing groups, and quaternary ammonium groups. In certain embodiments, the hydrophilic groups are selected from sulfur-based acids and/or their conjugate bases (e.g., $—SO_3^-$ or $—SO_3H$), phosphorus-based acids and/or their conjugate bases (e.g., $—OPO_3^{2-}$, $—OPO_3H^-$, $—OPO_3H_2$, $—PO_3H$, or $—PO_3^{2-}$), and carboxylic acids and/or their conjugate bases (e.g., $—CO_2H$ or $—CO_2^-$). In certain embodiments, the superhydrophilic surface layer includes sulfonate groups (i.e., sulfonate functionality). These materials can also have alkoxysilane-functional and/or silanol-functional groups. For certain embodiments, the hydrophilic-containing compounds are zwitterionic and for certain embodiments, they are non-zwitterionic. Other superhydrophilic materials are disclosed in commonly-owned U.S. Pat. Appl. Publ. No. 2020/0157302 (Jing et al.).

In some embodiments, the second surface of laminate may be treated using, for example, chemical treatment, corona treatment such as air or nitrogen corona, plasma, flame, or actinic radiation. The purpose of surface treatment may vary. One example of the purpose can be to improve adhesion to an overlying coating or to a substrate, or to change a property of the surface, such as surface free energy. Examples of changing the surface free energy by chemical treatment include the application of metal salt paraffin dispersion, polysiloxane, fluorocarbon polymers, and the combination thereof.

In some embodiments, the laminate can comprise inorganic materials. Examples of inorganic materials include, but not limited to, siliceous materials, silica (including organo-modified silica and unmodified nonporous spherical silica), ceramics, metal salts, inorganic composite, glass, minerals, and the combination thereof.

A variety of other ingredients may also be incorporated in the laminate compositions.

In one embodiment the coating weight of the laminate is between about 10 and about 60 grams per square meter (gsm). In one embodiment the coating weight of the laminate is between about 15 gsm and about 40 gsm. In one embodiment, the coating weight of the laminate is between about 15 gsm and about 25 gsm. The coating thickness of the laminate, in one embodiment, is between about 10 microns and about 50 microns. In one embodiment the coating thickness of the laminate is between about 10 microns and about 20 microns.

The abrasive elements comprise a make layer made from a curable composition (e.g., uncured or partially cured resin composition. In some instances, therefore, this specification makes reference to cured (e.g., cured resin composition) or uncured compositions (e.g., uncured or partially cured resin composition).

The nature of make layer comprising the uncured or partially cured resin composition that is converted to cured resin composition is non-limiting.

In preferred embodiments, the make layer precursor comprises a phenolic resin (e.g., PREFERE 80 5077A from Arclin, Mississauga, Ontario, Canada). Suitable phenolic resins are generally formed by condensation of phenol or an alkylated phenol (e.g., cresol) and formaldehyde, and are usually categorized as resole or novolac phenolic resins. Novolac phenolic resins are acid-catalyzed and have a molar ratio of formaldehyde to phenol of less than 1:1. Resole (also resol) phenolic resins can be catalyzed by alkaline catalysts, and the molar ratio of formaldehyde to phenol is greater than or equal to one, typically between 1.0 and 3.0, thus presenting pendant methylol groups Alkaline catalysts suitable for catalyzing the reaction between aldehyde and phenolic components of resole phenolic resins include sodium hydroxide, barium hydroxide, potassium hydroxide, calcium hydroxide, organic amines, and sodium carbonate, all as solutions of the catalyst dissolved in water.

Resole phenolic resins are typically coated as a solution with water and/or organic solvent (e.g., alcohol). Typically, the solution includes about 70 percent to about 85 percent solids by weight, although other concentrations may be used. If the solids content is very low, then more energy is required to remove the water and/or solvent. If the solids content is very high, then the viscosity of the resulting phenolic resin is too high which typically leads to processing problems.

Phenolic resins are well-known and readily available from commercial sources. Examples of commercially available resole phenolic resins useful in practice of the present disclosure include those marketed by Durez Corporation under the trade designation VARCUM (e.g., 29217, 29306, 29318, 29338, 29353); those marketed by Ashland Chemical Co. of Bartow, Florida under the trade designation AEROFENE (e.g., AEROFENE 295); and those marketed by Kangnam Chemical Company Ltd. of Seoul, South Korea under the trade designation PHENOLITE (e.g., PHENOLITE TD-2207).

The make layer precursor can comprise additional components, including polyurethane dispersions such as aliphatic and/or aromatic polyurethane dispersions. For example, polyurethane dispersions can comprise a polycarbonate polyurethane, a polyester polyurethane, or polyether polyurethane. The polyurethane can comprise a homopolymer or a copolymer.

Examples of commercially available polyurethane dispersions include aqueous aliphatic polyurethane emulsions available as NEOREZ R-960, NEOREZ R-966, NEOREZ R-967, NEOREZ R-9036, and NEOREZ R-9699 from DSM Neo Resins, Inc., Wilmington, Massachusetts; aqueous anionic polyurethane dispersions available as ESSENTIAL CC4520, ESSENTIAL CC4560, ESSENTIAL R4100, and ESSENTIAL R4188 from Essential Industries, Inc., Merton, Wisconsin; polyester polyurethane dispersions available as SANCURE 843, SANCURE 898, and SANCURE 12929 from Lubrizol, Inc. of Cleveland, Ohio; an aqueous aliphatic self-crosslinking polyurethane dispersion available as TURBOSET 2025 from Lubrizol, Inc.; and an aqueous anionic, co-solvent free, aliphatic self-crosslinking polyurethane dispersion, available as BAYHYDROL PR240 from Bayer Material Science, LLC of Pittsburgh, Pennsylvania Examples of additional suitable aqueous polyurethane dispersions are described in the specification of commonly-owned U.S. Pat. Appl. No. 62/803,879.

The make layer can comprise a crosslinked binder composition and is typically prepared by at least partially curing a curable make layer precursor. In such embodiments, the make layer preferably comprises a photocured crosslinked acrylic polymer, although any crosslinked polymeric binder material can be used. Details concerning photocurable acrylic monomers can be found, for example, in commonly-owned U.S. Pat. Appl. No. 63/058,832.

In some embodiments, the make layer may be a structured abrasive element comprising a plurality of shaped abrasive composites. Details concerning the molding and curing steps involved in making structured abrasive composites can be found, for example, in U.S. Pat. No. 5,152,917 (Pieper et al.) and U.S. Pat. Appl. Publ. No. 2011/0065362 A1 (Woo et al.).

The abrasive particles are dispersed throughout the make layer, or are partially embedded in the make layer.

Useful abrasive particles may be the result of a crushing operation (e.g., crushed abrasive particles that have been sorted for shape and size) or the result of a shaping operation (i.e., shaped abrasive particles) in which an abrasive precursor material is shaped (e.g., molded), dried, and converted to ceramic material. Combinations of abrasive particles resulting from crushing with abrasive particles resulting from a shaping operation may also be used. The abrasive particles may be in the form of, for example, individual particles, agglomerates, composite particles, and mixtures thereof.

The abrasive particles should have sufficient hardness and surface roughness to function as crushed abrasive particles in abrading processes. Preferably, the abrasive particles have a Mohs hardness of at least 4, at least 5, at least 6, at least 7, or even at least 8.

Suitable abrasive particles include, for example, crushed abrasive particles comprising fused aluminum oxide, heat-treated aluminum oxide, white fused aluminum oxide, ceramic aluminum oxide materials such as those commercially available as 3M CERAMIC ABRASIVE GRAIN from 3M Company, St. Paul, Minnesota, brown aluminum oxide, blue aluminum oxide, silicon carbide (including green silicon carbide), titanium diboride, boron carbide, tungsten carbide, garnet, titanium carbide, diamond, cubic boron nitride, garnet, fused alumina zirconia, iron oxide, chromic, zirconia, titanic, tin oxide, quartz, feldspar, flint, emery, sol-gel-derived ceramic (e.g., alpha alumina), and combinations thereof. Examples of sol-gel-derived abrasive particles from which the abrasive particles can be isolated, and methods for their preparation can be found, in U.S. Pat. No. 4,314,827 (Leitheiser et al.); U.S. Pat. No. 4,623,364 (Cottringer et al.); U.S. Pat. No. 4,744,802 (Schwabel), U.S. Pat. No. 4,770,671 (Monroe et al.); and U.S. Pat. No. 4,881,951 (Monroe et al.). It is also contemplated that the abrasive particles could comprise abrasive agglomerates such, for example, as those described in U.S. Pat. No. 4,652,275 (Bloecher et al.) or U.S. Pat. No. 4,799,939 (Bloecher et al.). In some embodiments, the abrasive particles may be surface-treated with a coupling agent (e.g., an organosilane coupling agent) or other physical treatment (e.g., iron oxide or titanium oxide) to enhance adhesion of the crushed abrasive particles to the binder. The abrasive particles may be treated before combining them with the binder, or they may be surface treated in situ by including a coupling agent to the binder.

Preferably, the abrasive particles (and especially the abrasive particles) comprise ceramic abrasive particles such as, for example, sol-gel-derived polycrystalline alpha alumina particles. Ceramic abrasive particles composed of crystallites of alpha alumina, magnesium alumina spinel, and a rare earth hexagonal aluminate may be prepared using sol-gel precursor alpha alumina particles according to methods described in, for example, U.S. Pat. No. 5,213,591 (Celikkaya et al.) and U.S. Publ. Pat. Appl. Nos. 2009/0165394 A1 (Culler et al.) and 2009/0169816 A1 (Erickson et al.). Further details concerning methods of making sol-gel-derived abrasive particles can be found in, for example, U.S. Pat. No. 4,314,827 (Leitheiser); U.S. Pat. No. 5,152,917 (Pieper et al.); U.S. Pat. No. 5,435,816 (Spurgeon et al.); U.S. Pat. No. 5,672,097 (Hoopman et al.); U.S. Pat. No. 5,946,991 (Hoopman et al.); U.S. Pat. No. 5,975,987 (Hoopman et al.); and U.S. Pat. No. 6,129,540 (Hoopman et al.); and in U.S. Publ. Pat. Appl. No. 2009/0165394 A1 (Culler et al.).

In some preferred embodiments, the abrasive particles may be formed abrasive particles. As used herein, the term "formed abrasive particles" generally refers to abrasive particles (e.g., formed ceramic abrasive particles) having at least a partially replicated shape. Useful abrasive particles may be formed abrasive particles can be found in U.S. Pat. No. 5,201,916 (Berg); U.S. Pat. No. 5,366,523 (Rowenhorst (Re 35,570)); and U.S. Pat. No. 5,984,988 (Berg). U.S. Pat. No. 8,034,137 (Erickson et al.) describes alumina abrasive particles that have been formed in a specific shape, then crushed to form shards that retain a portion of their original shape features.

Formed abrasive particles also include shaped abrasive particles. As used herein, the term "shaped abrasive particle," generally refers to abrasive particles with at least a portion of the abrasive particles having a predetermined shape that is replicated from a mold cavity used to form the shaped precursor abrasive particle. Shaped abrasive particle as used herein excludes randomly sized abrasive particles obtained by a mechanical crushing operation. Details concerning such abrasive particles and methods for their preparation can be found, for example, in U.S. Pat. No. 8,142,531 (Adefris et al.); U.S. Pat. No. 8,142,891 (Culler et al.); U.S. Pat. No. 8,142,532 (Erickson et al.); U.S. Pat. No. 9,771,504 (Adefris); and in U.S. Pat. Appl. Publ. Nos. 2012/0227333 (Adefris et al.); 2013/0040537 (Schwabel et al.); 2013/0125477 (Adefris); and 2015/0267097 (Rosenflanz et al.). One particularly useful precisely-shaped abrasive particle shape is that of a platelet having three-sidewalls, any of which may be straight or concave, and which may be vertical or sloping with respect to the platelet base; for example, as set forth in the above cited references.

It is expressly contemplated that the method illustrated can be applied to other abrasive particles, such as platey, or partially shaped particles.

Surface coatings on the abrasive particles may be used to improve the adhesion between the abrasive particles and a binder material, or to aid in electrostatic deposition of the abrasive particles. In one embodiment, surface coatings as described in U.S. Pat. No. 5,352,254 (Celikkaya) in an amount of 0.1 to 2 percent surface coating to abrasive particle weight may be used. Such surface coatings are described in U.S. Pat. No. 5,213,591 (Celikkaya et al.); U.S. Pat. No. 5,011,508 (Wald et al.); U.S. Pat. No. 1,910,444 (Nicholson); U.S. Pat. No. 3,041,156 (Rowse et al.); U.S. Pat. No. 5,009,675 (Kunz et al.); U.S. Pat. No. 5,085,671 (Martin et al.); U.S. Pat. No. 4,997,461 (Markhoff-Matheny et al.); and U.S. Pat. No. 5,042,991 (Kunz et al.). Additionally, the surface coating may prevent shaped abrasive particles from capping. Capping is the term to describe the phenomenon where metal particles from the workpiece being abraded become welded to the tops of the abrasive particles. Surface coatings to perform the above functions are known to those of skill in the art.

In some embodiments, the abrasive particles may be selected to have a length and/or width in a range of from 0.1 micrometers to 3.5 millimeters (mm), more typically 0.05 mm to 3.0 mm, and more typically 0.1 mm to 2.6 mm, although other lengths and widths may also be used.

The abrasive particles may be selected to have a thickness in a range of from 0.1 micrometer to 1.6 mm, more typically from 1 micrometer to 1.2 mm, although other thicknesses may be used. In some embodiments, abrasive particles may have an aspect ratio (length to thickness) of at least 2, 3, 4, 5, 6, or more.

Abrasive particles may be independently sized according to an abrasives industry recognized specified nominal grade. Exemplary abrasive industry recognized grading standards include those promulgated by ANSI (American National Standards Institute), FEPA (Federation of European Producers of Abrasives), and JIS (Japanese Industrial Standard) Such industry accepted grading standards include, for example: ANSI 4, ANSI 6, ANSI 8, ANSI 16, ANSI 24, ANSI 30, ANSI 36, ANSI 40, ANSI 50, ANSI 60, ANSI 80, ANSI 100, ANSI 120, ANSI 150, ANSI 180, ANSI 220, ANSI 240, ANSI 280, ANSI 320, ANSI 360, ANSI 400, and ANSI 600; FEPA P8, FEPA P12, FEPA P16, FEPA P24, FEPA P30, FEPA P36, FEPA P40, FEPA P50, FEPA P60, FEPA P80, FEPA P100, FEPA P120, FEPA P150, FEPA P180, FEPA P220, FEPA P320, FEPA P400, FEPA P500, FEPA P600, FEPA P800, FEPA P1000, FEPA P1200; FEPA F8, FEPA F12, FEPA F16, and FEPA F24; and JIS 8, JIS 12, JIS 16, JIS 24, JIS 36, JIS 46, JIS 54, JIS 60, JIS 80, JIS 100, JIS 150, JIS 180, JIS 220, JIS 240, JIS 280, JIS 320, JIS 360, JIS 400, JIS 600, JIS 800, JIS 1000, JIS 1500, JIS 2500, JIS 4000, JIS 6000, JIS 8000, and JIS 10,000. More typically, the crushed aluminum oxide particles and the non-seeded sol-gel derived alumina-based abrasive particles are independently sized to ANSI 60 and 80, or FEPA F36, F46, F54 and F60 or FEPA P60 and P80 grading standards.

Alternatively, the abrasive particles can be graded to a nominal screened grade using U.S.A. Standard Test Sieves conforming to ASTM E-11 "Standard Specification for Wire Cloth and Sieves for Testing Purposes". ASTM E-11 prescribes the requirements for the design and construction of testing sieves using a medium of woven wire cloth mounted in a frame for the classification of materials according to a designated particle size. A typical designation may be represented as −18+20 meaning that the shaped abrasive particles pass through a test sieve meeting ASTM E-11 specification for the number 18 sieve and are retained on a test sieve meeting ASTM E-11 specification for the number 20 sieve. In one embodiment, the shaped abrasive particles have a particle size such that most of the particles pass through an 18-mesh test sieve and can be retained on a 20, 25, 30, 35, 40, 45, or 50 mesh test sieve. In various embodiments, the shaped abrasive particles can have a nominal screened grade comprising: 18+20, 20+25, 25+30, 30+35, 35+40, 40+45, 45+50, 50+60, 60+70, 70+80, 80+100, 100+120, 120+140, 140+170, 170+200, 200+230, 230+270, 270+325, 325+400, 400+450, 450+500, or 500+635. Alternatively, a custom mesh size could be used such as 90+100.

Abrasive agglomerate particles such as those described in the specification of commonly-owned U.S. Pat. Appl. No. 62/945,242 may be especially useful for making abrasive articles described herein. At least one dimension of the abrasive agglomerate particles can be greater than the gaps in porous substrates, ensuring that abrasive agglomerate particles do not fall through the pores on the porous substrates during the making process of the abrasive articles.

The abrasive particles 250 can optionally be oriented by influence of a magnetic field prior to the make layer precursor being cured. See, for example, commonly-owned PCT Pub. Nos. WO 2018/080703, WO 2018/080756, WO 2018/080704, WO 2018/080705, WO 2018/080765, WO 2018/080784, WO 2018/136271, WO 2018/134732, WO 2018/080755, WO 2018/080799, WO 2018/136269, and WO 2018/136268.

In some embodiments, the abrasive particles can optionally be placed using tools for controlled orientation and placement of abrasive particles. See, for example, commonly-owned PCT Pub. Nos. WO 2012/112305, WO 2015/100020, WO 2015/100220, WO 2015/100018, WO 2016/028683, WO 2016/089675, WO 2018/063962, WO 2018/063960, WO 2018/063958, WO 2019/102312, WO 2019/102328, WO 2019/102329, WO 2019/102330, WO 2019/102331, WO 2019/102332, WO 2016/205133, WO 2016/205267, WO 2017/007714, WO 2017/007703, WO 2018/118690, WO 2018/118699, WO 2018/118688, U.S. Pat. Pub. No. 2019/0275641, and U. S. Provisional Pat. Appl. Nos. 62/751,097, 62/767,853, 62/767,888, 62/780,987, 62/780,988, 62/780,994, 62/780,998, 62/781,009, 62/781,021, 62/781,037, 62/781,043, 62/781,057, 62/781,072, 62/781,077, 62/781,082, 62/825,938, and 62/781,103.

In embodiments shown in FIG. 3, a size layer 510 comprising polymeric binder is disposed on at least a portion of, preferably at least substantially all of the make layer. While it is permissible for minimal amounts of the size layer to extend beyond the make layer, it is preferred that the size layer resides substantially completely on the make layer and abrasive particles.

The size layer can be prepared in the same manner from a size layer precursor comprising any of the foregoing curable materials in the make layer, which may be the same as or different from the size layer. In preferred embodiments the size layer comprises a cured phenolic resin; e.g., as described hereinabove. The size layer precursor may be applied to the make layer and cured to form the size layer by any suitable technique, including those used for applying and curing the make layer precursor.

In addition to other components, the make and size layers and their precursors may further contain optional additives, for example, to modify performance and/or appearance. Exemplary additives include grinding aids, fillers, plasticizers, wetting agents, surfactants, pigments, coupling agents, fibers, lubricants, thixotropic materials, antistatic agents, suspending agents, and/or dyes.

Exemplary grinding aids, which may be organic or inorganic, include waxes, halogenated organic compounds such as chlorinated waxes like tetrachloronaphthalene, pentachloronaphthalene, and polyvinyl chloride; halide salts such as sodium chloride, potassium cryolite, sodium cryolite, ammonium cryolite, potassium tetrafluoroborate, sodium tetrafluoroborate, silicon fluorides, potassium chloride, magnesium chloride; and metals and their alloys such as tin, lead, bismuth, cobalt, antimony, cadmium, iron, and titanium. Examples of other grinding aids include sulfur, organic sulfur compounds, graphite, and metallic sulfides. A combination of different grinding aids can be used. Exemplary antistatic agents include electrically conductive material such as vanadium pentoxide (e.g., dispersed in a sulfonated polyester), humectants, carbon black and/or graphite in a binder.

Examples of useful fillers for this disclosure include silica such as quartz, glass beads, glass bubbles and glass fibers; silicates such as talc, clays, (montmorillonite) feldspar, mica, calcium silicate, calcium metasilicate, sodium aluminosilicate, sodium silicate; metal sulfates such as calcium sulfate, barium sulfate, sodium sulfate, aluminum sodium sulfate, aluminum sulfate; gypsum; vermiculite; wood flour; aluminum trihydrate; carbon black; aluminum oxide; titanium dioxide; cryolite; chiolite; and metal sulfites such as calcium sulfite.

The abrasive article may optionally also include a supersize layer 610. In general, the supersize layer is the outermost coating of the abrasive article and directly contacts the workpiece during an abrading operation. It may be disposed on the size layer, the make layer if there is no size layer, and uncoated portions of the porous substrate, for example. The optional supersize layer may serve to prevent or reduce the accumulation of swarf (the material abraded from a workpiece) between abrasive particles, which can dramatically reduce the cutting ability of the coated abrasive disc. Useful supersize layers typically include a grinding aid (e.g., potassium tetrafluoroborate), metal salts of fatty acids (e.g., zinc stearate or calcium stearate), salts of phosphate esters (e.g., potassium behenyl phosphate), phosphate esters, urea-formaldehyde resins, mineral oils, crosslinked silanes, crosslinked silicones, and/or fluorochemicals. Useful supersize materials are further described, for example, in U.S. Pat. No. 5,556,437 (Lee et al.). Typically, the amount of grinding aid incorporated into coated abrasive articles is about 50 to about 400 gsm, more typically about 80 to about 300 gsm. The supersize may contain a binder such as for example, those used to prepare the size or make layer, but it need not have any binder.

In some embodiments, the abrasive articles can contain one or more fiber reinforcement materials. The use of a fiber reinforcement material can provide an abrasive element having improved cold flow properties, limited stretchability, and enhanced strength. Preferably, the one or more fiber reinforcement materials can have a certain degree of porosity that enables a photoinitiator, when present, to be dispersed throughout, to be activated by UV light, and properly cured without the need for heat.

The one or more fiber reinforcements may comprise one or more fiber-containing webs including, but not limited to, woven fabrics, nonwoven fabrics, knitted fabrics, and a unidirectional array of fibers. The one or more fiber reinforcements could comprise a nonwoven porous, such as a scrim.

Materials for making the one or more fiber reinforcements may include any fiber-forming material capable of being formed into one of the above-described webs. Suitable fiber-forming materials include, but are not limited to, polymeric materials such as polyesters, polyolefins, and aramids; organic materials such as wood pulp and cotton; inorganic materials such as glass, carbon, and ceramic; coated fibers having a core component (e.g., any of the above fibers) and a coating thereon; and combinations thereof.

Further options and advantages of the fiber reinforcement materials are described in U.S. Patent Publication No. 2002/0182955 (Weglewski et al.).

Methods of making an abrasive article generally comprise joining a laminate to a porous substrate, joining a curable resin composition to the laminate opposite the porous substrate; and joining abrasive particles to the curable resin composition.

In a first step, a laminate is joined to a porous substrate comprising strands forming first void spaces between the strands (e.g., as described hereinabove). The laminate can be joined to the porous substrate by any suitable means, including by first applying a suitable adhesive layer (not shown) onto the substrate, followed by applying the laminate (e.g., by melting the laminate material onto the porous substrate; printing the laminate onto the porous substrate; or combinations of any of the foregoing methods for joining the laminate) to the porous substrate.

Figure 5A:
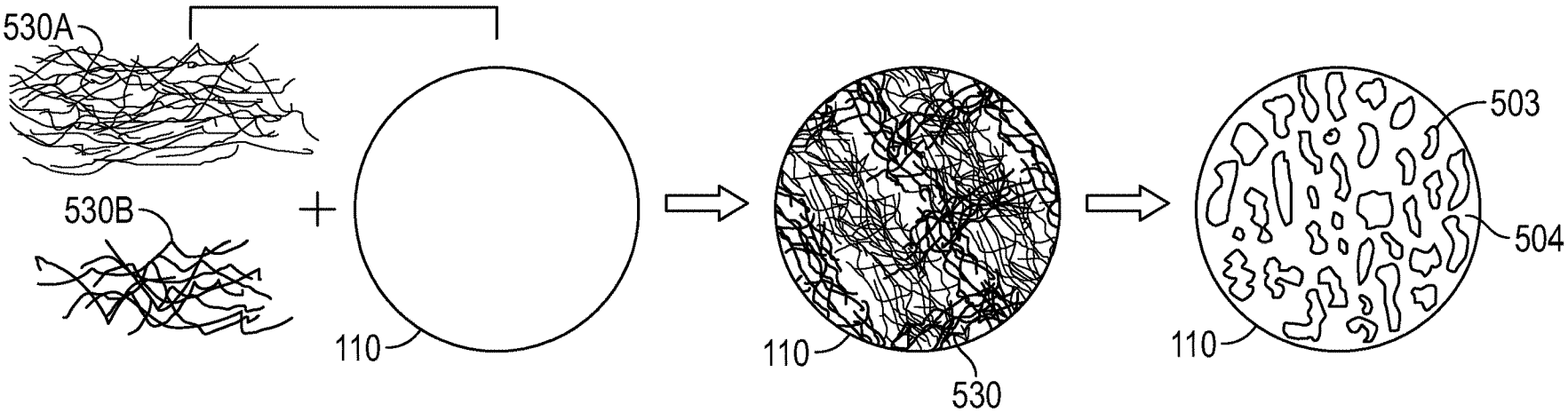
FIGS. 5A-5C are schematic illustrations of examples of methods of making laminated substrates according to embodiments of the present disclosure.
Figure 5B:
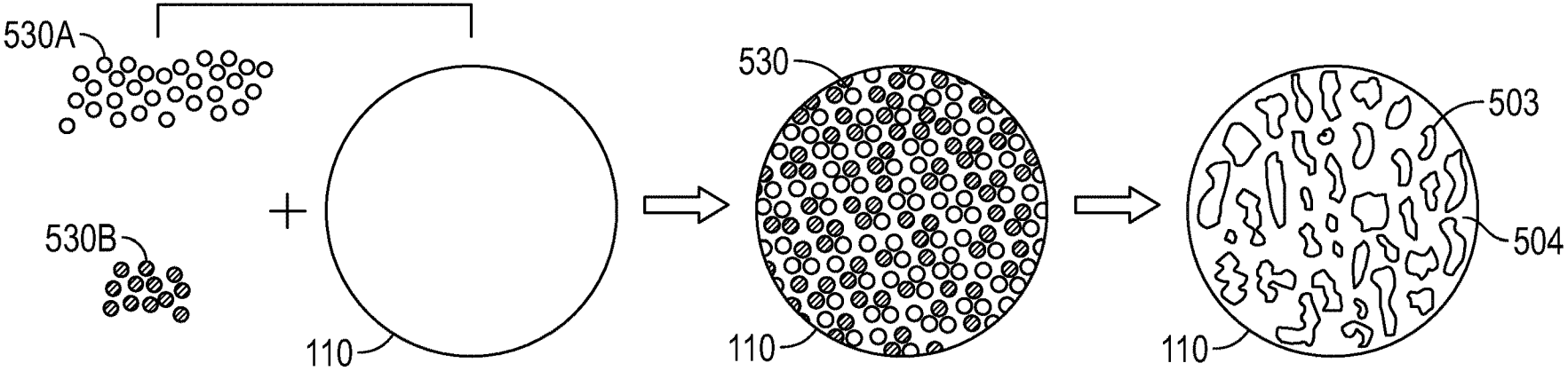
Figure 5C:
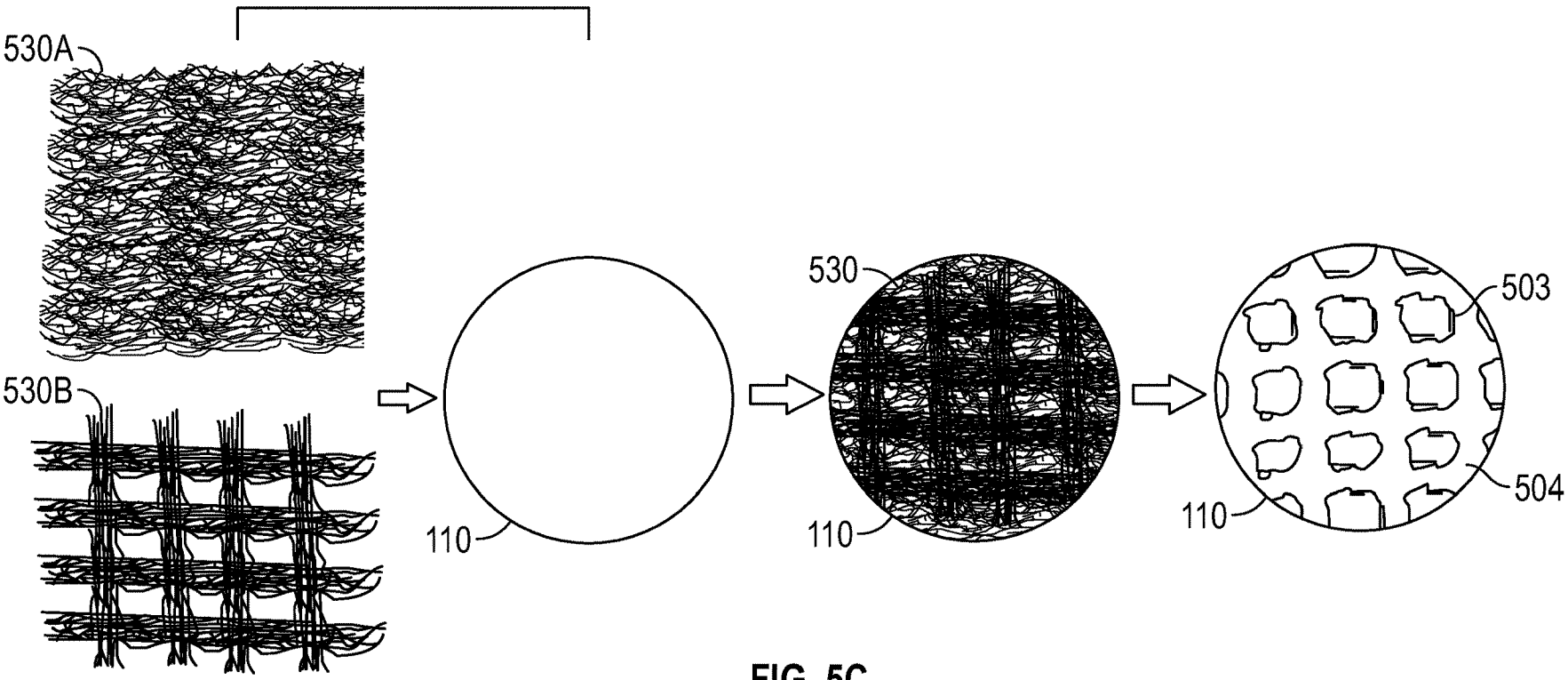

Several examples of applying the laminate to substrate using hot press lamination are shown in FIGS. 5A-5C. In these examples, although two polymers (i.e. 530A and 530B) are demonstrated as laminate materials 530, it is to be understood that the laminate materials can be non-limiting, as described hereinabove. The starting laminate materials 530 could be in a form of nonwoven fibers (for example, FIG. 5A), pellet (for example, FIG. 5B), or films (FIG. 5C, details can be found in, for example, as described in commonly-owned U.S. Pat. Appl. No. 62/945,244). After the hot press lamination on the substrate, a first portion 503 and a second portion 504 could be formed on the surface of the laminate. In some embodiments, at least one starting laminate material can comprise a structural pattern (for example, 503B in FIG. 5C), or at least one starting laminate material can be laminated with a predetermined pattern by using any suitable means of pattern coating, for example, with a screen or a stencil. This can result in lamination with patterns, i.e., the first portion 503 and the second portion 504 can be arrayed in at least one pattern on the laminate surface.

The laminate functions to, among other things, provide a substantially flat landing for uncured (or partially cured) resin composition, such that uncured resin composition that is deposited on the laminate remains on the surface and does not have an opportunity to, e.g., move into the spaces between strands of the porous substrate.

In a second step, uncured resin composition is joined to the laminate opposite the porous substrate. The uncured resin composition can be joined to the laminate by any suitable means; for example, by directly coating the uncured resin composition onto the laminate or by using combinations of two or more suitable methods (e.g., extrusion die coating, curtain coating, knife coating, gravure coating, and spray coating) for joining the uncured resin composition to the laminate opposite the porous substrate. In some embodiments, the uncured resin composition can be applied onto the laminate by using a (rotary) stencil/screen printing roll, or flatbed screen/stencil printing.

In various embodiments, an uncured make resin composition is liquid based. For example, the uncured make resin composition can be in a form of suspension, solution, or emulsion. When the uncured make resin composition is applied to the laminate, the uncured make resin composition have a tendency of migrating to the portions with relatively high surface free energy from the portions with relatively low surface free energy on the laminate surface. The rate of migrating may depend on the viscosity of the uncured make resin composition, and on the surface free energy on the laminate surface. An uncured make resin composition with a low viscosity may migrate to the portion with relatively high surface free energy less than seconds, while an uncured make resin composition with a higher viscosity may take longer time (e.g., seconds, minutes, or hours) to migrate to the portion with relatively high surface free energy. In preferred embodiments, an uncured make resin composition can form a plurality of discrete areas or interconnected sections on the laminate surface.

In some embodiments, an uncured make resin composition is aqueous based, and the laminate comprises hydrophobic and hydrophilic materials. After the aqueous uncured make resin composition is applied, it tends to shrink away from the hydrophobic surface portion and gather on the hydrophilic surface portion on the laminate surface to form a plurality of discrete areas or interconnected sections.

In a third step, abrasive particles are joined to the uncured resin composition by any suitable method, including drop, electrostatic, magnetic, and other mechanical methods of mineral coating. For example, abrasive particles can be deposited onto uncured resin composition by simply dropping the abrasive particles onto the uncured resin composition; by electrostatically depositing abrasive particles onto the uncured resin composition; or by using combinations of two or more suitable methods for joining the abrasive particles to the uncured resin composition. In some embodiments, the abrasive particles can optionally be oriented under the influence of a magnetic field, or with a placement tool, prior to the resin being cured, as earlier indicated.

In a fourth step, the uncured resin composition is cured, this way abrasive particles are at least partially embedded in the cured resin composition and are substantially permanently attached. Uncured resin composition can be cured to form cured resin by any applicable curing mechanism, including thermal cure, photochemical cure, moisture-cured or combinations of two or more curing mechanism. But if the uncured resin composition is cured by any means that does not include heating, a fifth step (not shown) may be necessary to effect migration of the laminate away from the void spaces between the strands.

During the curing process, at least a portion of the laminate that is not covered by cured resin composition migrates away from the first void spaces between the strands, thereby opening a plurality of the second void spaces extending through the laminate coinciding with the first void spaces. The laminate therefore avoids the first void spaces when the cured resin composition is absent above the first void spaces. Moreover, the laminate covers the first void spaces when the cured resin composition is above the first void spaces. The cured resin composition supports the laminate above the first void spaces.

U.S. Patent Application No. 2016/0009048 A1 (Slama et al.) and U.S. Pat. No. 7,037,100 (Strobel et al.) describes methods and materials for heating a laminate on a porous substrate to cause retraction and pore formation. Preferably, the melting temperature of the laminate is below the curing temperature of the make resin.

Methods by which the abrasive article is made are also contemplated where one or more of the steps described herein can be accomplished in a single step or wherein certain steps can be performed in an order different from described hereinabove. For example, uncured or partially cured resin composition could be joined/deposited to the laminate first to form a first composite. The first composite material comprising uncured or partially cured resin and the laminate could then be joined in a single step to the porous substrate, followed by Steps 3 and 4. Alternatively, the laminate and uncured or partially cured resin composition could be co-deposited (e.g., co-extruded) onto porous substrate 110, followed by Steps 3 and 4.

In yet another alternative, abrasive particles can be joined with uncured or partially cured resin composition first to form a second composite. In this instance, uncured or partially cured resin composition could be joined/deposited on a removable liner first. The abrasive particles 250 could then be joined/deposited onto the uncured or partially cured resin composition to form the second composite. The second composite material comprising abrasive particles joined with uncured or partially cured resin composition could then be joined/deposited to laminate to make a third composite material. The third composite material comprising abrasive particles joined with uncured or partially cured resin composition, which is in turn joined to laminate, could then be joined in a single step to porous substrate, followed by Steps 3 and 4. Examples of method of making abrasive articles can be further found in commonly-owned U.S. Pat. Appl. Nos. 62/945,242, 62/945,244, 62/945,333, 62/954,964 62/954,964, 63/004,920, 63/026,986, 63/058,832 and PCT Pat. Appl. Publ. No. WO 2019/111212.

SELECT EMBODIMENTS OF THE PRESENT DISCLOSURE

In a first embodiment, the present disclosure provides an abrasive article comprising a substrate comprising strands forming first void spaces between strands; a laminate joined to the substrate, wherein the laminate comprises a surface opposite to the substrate; a resin composition joined to the surface of the laminate, wherein a first portion of the surface of the laminate has a first surface free energy, wherein a second portion of the surface of the laminate has a second surface free energy, and wherein the first surface free energy is different from the second surface free energy; and abrasive particles joined to the resin composition, wherein a plurality of second void spaces extends through the laminate coinciding with first void spaces in the porous substrate.

In a second embodiment, the present disclosure provides an abrasive article comprising a substrate comprising strands forming first void spaces between strands; a laminate joined to the substrate, wherein the laminate comprises a first polymer and a second polymer; a resin composition joined to the laminate; and abrasive particles joined to the resin composition, wherein a plurality of second void spaces extends through the laminate coinciding with first void spaces in the porous substrate.

In a third embodiment, the present disclosure the abrasive article according to the second embodiment, wherein the first polymer has a first surface free energy, the second polymer has a second surface free energy, wherein the first surface free energy and the second surface free energy are different.

In a fourth embodiment, the present disclosure provides the abrasive article according to the second or the third embodiments, wherein the first polymer is hydrophilic and the second polymer is hydrophobic.

In a fifth embodiment, the present disclosure provides the abrasive article according to any one of the first to fourth embodiments, wherein the resin composition is water-based adhesive.

In a sixth embodiment, the present disclosure provides the abrasive article according to any one of the first and the third to fifth embodiments, wherein the difference of the first surface free energy and the second surface free energy is at least 3 mN/m at 20 degrees Celsius.

In a seventh embodiment, the present disclosure provides the abrasive article according to any one of the first and the third to fifth embodiments, wherein the difference of the first surface free energy and the second surface free energy is at least 5 mN/m at 20 degrees Celsius.

In an eighth embodiment, the present disclosure provides the abrasive article according to any one of the first and the third to fifth embodiments, wherein the difference of the first surface free energy and the second surface free energy is at least 8 mN/m at 20 degrees Celsius.

In a ninth embodiment, the present disclosure provides the abrasive article according to any one of the first to eighth embodiments, wherein the laminate at least partially wraps around the strands to leave open the first and second void spaces.

In a tenth embodiment, the present disclosure provides the abrasive article according to any one of the first to ninth embodiments, wherein the laminate avoids the first void spaces when cured resin composition is absent above the first void spaces.

In an eleventh embodiment, the present disclosure provides the abrasive article according to any one of the first to tenth embodiments, wherein the laminate covers the first void spaces when the cured resin composition is above the first void spaces.

In a twelfth embodiment, the present disclosure provides the abrasive article according to any one of the first to eleventh embodiments, wherein the resin composition has a higher melting point than the laminate.

In a thirteenth embodiment, the present disclosure provides the abrasive article according to any one of the first to twelfth embodiments, wherein the laminate comprises at least a hot-melt material.

In a fourteenth embodiment, the present disclosure provides the abrasive article according to any one of the first to thirteenth embodiments, wherein the abrasive particles comprise shaped abrasive particles.

In a fifteenth embodiment, the present disclosure provides the abrasive article according to any one of the first to fourteenth embodiments, wherein the first portion and the second portion are distributed randomly on the surface of the laminate.

In a sixteenth embodiment, the present disclosure provides the abrasive article according to any one of the first to fifteenth embodiments, wherein the first portion and the second portion array in a pattern on the surface of the laminate.

In a seventeenth embodiment, the present disclosure provides the abrasive article according to any one of the first to sixteenth embodiments, wherein at least one of the first portion and the second portion is a plurality of discrete areas on the surface of the laminate.

In an eighteenth embodiment, the present disclosure provides the abrasive article according to any one of the first to seventeenth embodiments, wherein at least one of the first portion and the second portion is an interconnected section.

In a nineteenth embodiment, the present disclosure provides the abrasive article according to any one of the first to eighteenth embodiments, wherein the surface of the laminate comprises a third portion having a third surface free energy, wherein the third surface free energy is different from the first and second surface free energies.

In a twentieth embodiment, the present disclosure provides the abrasive article according to any one of the first to nineteenth embodiments, wherein the abrasive article further comprises at least one part of hook and loop attachment system.

In a twenty-first embodiment, the present disclosure provides the abrasive article according to any one of the second to twentieth embodiments, wherein the laminate comprises a third polymer having a third surface free energy.

In a twenty-second embodiment, the present disclosure provides a method of making an abrasive article, the method comprising joining a laminate to a porous substrate, wherein the porous substrate comprises strands forming first void spaces between the strands, and wherein the laminate comprises a first polymer and a second polymer; joining a curable resin composition to the laminate opposite the porous substrate; joining abrasive particles to the curable resin composition; and forming a plurality of second void spaces extending through the laminate coinciding with first void spaces in the porous substrate.

In a twenty-third embodiment, the present disclosure provides a method of making an abrasive article according to the twenty-second embodiment, wherein the first polymer has a first surface free energy, the second polymer has a second surface free energy, wherein the first surface free energy and the second surface free energy are different.

In a twenty-fourth embodiment, the present disclosure provides a method of making an abrasive article according to the twenty-second or twenty-third embodiments, wherein the first polymer is hydrophilic and the second polymer is hydrophobic.

In a twenty-fifth embodiment, the present disclosure provides a method of making an abrasive article according to the twenty-third or twenty-fourth embodiments, wherein the difference of the first surface free energy and the second surface free energy is at least 3 mN/m at 20 degrees Celsius.

In a twenty-sixth embodiment, the present disclosure provides a method of making an abrasive article according to any one of the twenty-second to twenty-fifth embodiments, wherein the resin composition is water-based adhesive.

In a twenty-seventh embodiment, the present disclosure provides a method of making an abrasive article according to any one of the twenty-second to twenty-sixth embodiments, the method further comprises at least partially curing the curable resin composition.

In a twenty-eighth embodiment, the present disclosure provides a method of making an abrasive article according to any one of the twenty-second to twenty-seventh embodiments, wherein said forming a plurality of second void spaces comprises heating.

Objects and advantages of this disclosure are further illustrated by the following non-limiting examples, but the particular materials and amounts thereof recited in these examples, as well as other conditions and details, should not be construed to unduly limit this disclosure.

EXAMPLES

Unless otherwise noted, all parts, percentages, ratios, etc. in the Examples and the rest of the specification are by weight. Unless stated otherwise, all reagents were obtained or are available from chemical vendors such as Sigma-Aldrich Company, St. Louis, Missouri, or may be synthesized by known methods. Unit Abbreviations used in the Examples: gsm=grams per square meter; cm=centimeter; μm=micrometer; ° C.=degree Celsius. Materials used in the Examples are described in Table 1, below.

TABLE 1

| | |
|---|---|
| MESH | Net Mesh GR150 H100 (150 gsm) with loops knitted on one side available from SitiP, S.p.A., Cene, Italy. |
| PET-MELTY | Polyester nonwoven web hot melt adhesive, 15-18 gsm basis weight, commercially available as PE120 from Bostik, Inc, Wauwatosa, Wisconsin. |
| PP-MELTY | Polypropylene (PP) nonwoven web hot melt adhesive, 15-20 gsm basis weight, with softening pointing 110 ± 8° C., commercially available as DS617L-3 from Shenzhen Tunsing Plastic Products Co., Ltd, Shenzhen, Guangdong, China. |
| PE-MELTY | Bicomponent spunbond nonwoven fabric containing 50% polyethylene (PE) and has a melting point around 130° C., 18-25 gsm basis weight, available as EP-Z from Shaoxing Yaolong Spunbonded Nonwoven Technology Co., Ltd., Zhejiang, China. |
| PFR1 | Phenol-formaldehyde resin having a phenol to formaldehyde molar ratio of 1:1.5-2.1, and catalyzed with 2.5 percent by weight potassium hydroxide. |
| PFR2 | GP8339 water-based phenol-formaldehyde resin supplied by Georgia-Pacific Chemicals LLC, Atlanta, Georgia, with 75% solids. |
| CACO | Calcium carbonate commercially available as HUBERCARB Q325 from Hubercarb Engineered Materials, Atlanta, Georgia. |

TABLE 1-continued

| | |
|---|---|
| CB | Carbon black dispersion KW3729 (34% solid) from Heucotech Ltd., Fairless Hills, Pennsylvania. |
| RED | Red synthetic iron oxide pigment available as KROMA from Venator Americas LLC, The Woodlands, Texas. |
| INTERWET | Interwet-33 surfactant supplied by Valtris Specialty Chemicals, Walton Hills, Ohio. |
| MKR1 | Phenolic make resin 1, prepared by mixing 55 parts by weight of PFR1, 44.8 parts by weight of CACO, and 0.2 parts of CB. Added 10 parts additional water to adjust the viscosity of the solution to around 2300 centipoise (cps) before coating. |
| MKR2 | Phenolic make resin 2, prepared by mixing 97.2 parts by weight of PFR2, 1 part by weight of water, 1.6 parts by weight of RED, and 0.2 parts by weight of INTERWET. Add 10 parts additional water to adjust the viscosity of the solution to 110 cps before coating. |
| AO | Alpha aluminum oxide abrasive mineral particles supplied by Jiangsu Leyuan New Materials Group Co., Ltd, Lianyungang City, China. The sizes of the alpha aluminum oxide abrasive mineral particles are specified as below. |
| SAP | Shaped abrasive particles were prepared according to the disclosure of U.S. Pat. No. 8,142,531 (Adefris et al.). The shaped abrasive particles were prepared by molding alumina sol gel in equilateral triangle-shaped polypropylene mold cavities. The draft angle between the sidewall and bottom of the mold was 98 degrees. After drying and firing, the resulting shaped abrasive particles were about 0.18 millimeter (side length) × 0.045 millimeter (thickness). The shaped abrasive particles made as described above are used, for example, in 3M Cubitron II Hookit Clean Sanding abrasive disc 737U, grade 220+, available from 3M Company, St. Paul, Minnesota. |

Laminated Substrate 1

A backing MESH with a diameter of 3.5 inch was placed on the hot-plate of a steam press (available as STEAMFAST Model SF-680 from Vornado air, LLC, Andover, Kansas). PE-MELTY and PET-MELTY strips were randomly placed on non-loop side of the mesh backing to cover the surface of the mesh backing. PE-MELTY covered about 60% of the surface, and PET-MELTY covered about 40% of the surface. The weight of the PE-MELTY used in the example was about 18 gsm by calculation. The mesh backing together with the melty layer was pressed at 135° C. for about 10 seconds to laminate the melty layer onto the mesh backing. The sample was then cooled down to around 23° C.

Figure 6:
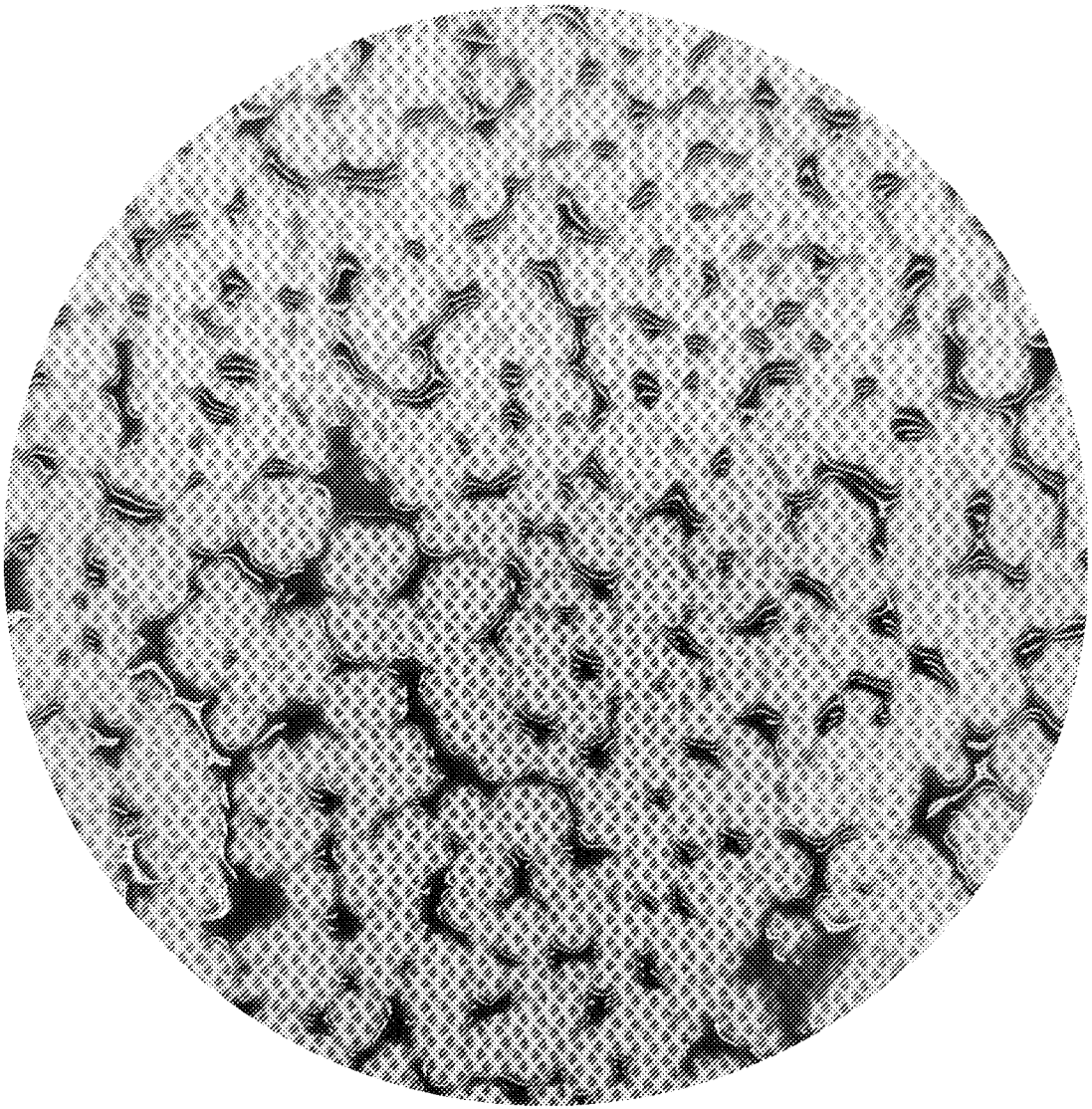
FIG. 6 is a digital photograph of top view of make layer coated, laminated article made according to embodiments of the present disclosure.

A piece of Laminated Substrate 1 was placed on a balance. Make resin MKR1 was applied onto the laminate with a putty knife with the target add-on of 1.5-2 grams per 50 square inches. As MKR1 was applied, it immediately de-wetted on portions of the laminated surface and formed randomly distributed areas on the laminated backing, as shown in FIG. 6.

Laminated Substrate 2

The procedure described in Laminated Substrate 1 was generally repeated, except that PP-MELTY was used to cover about 60% of the mesh surface, and PET-MELTY covered about 40% of the surface. The hot-press was conducted at 150° C. The weight of the PP-MELTY used in the example was about 25 gsm by calculation.

Example 1

Figure 7:
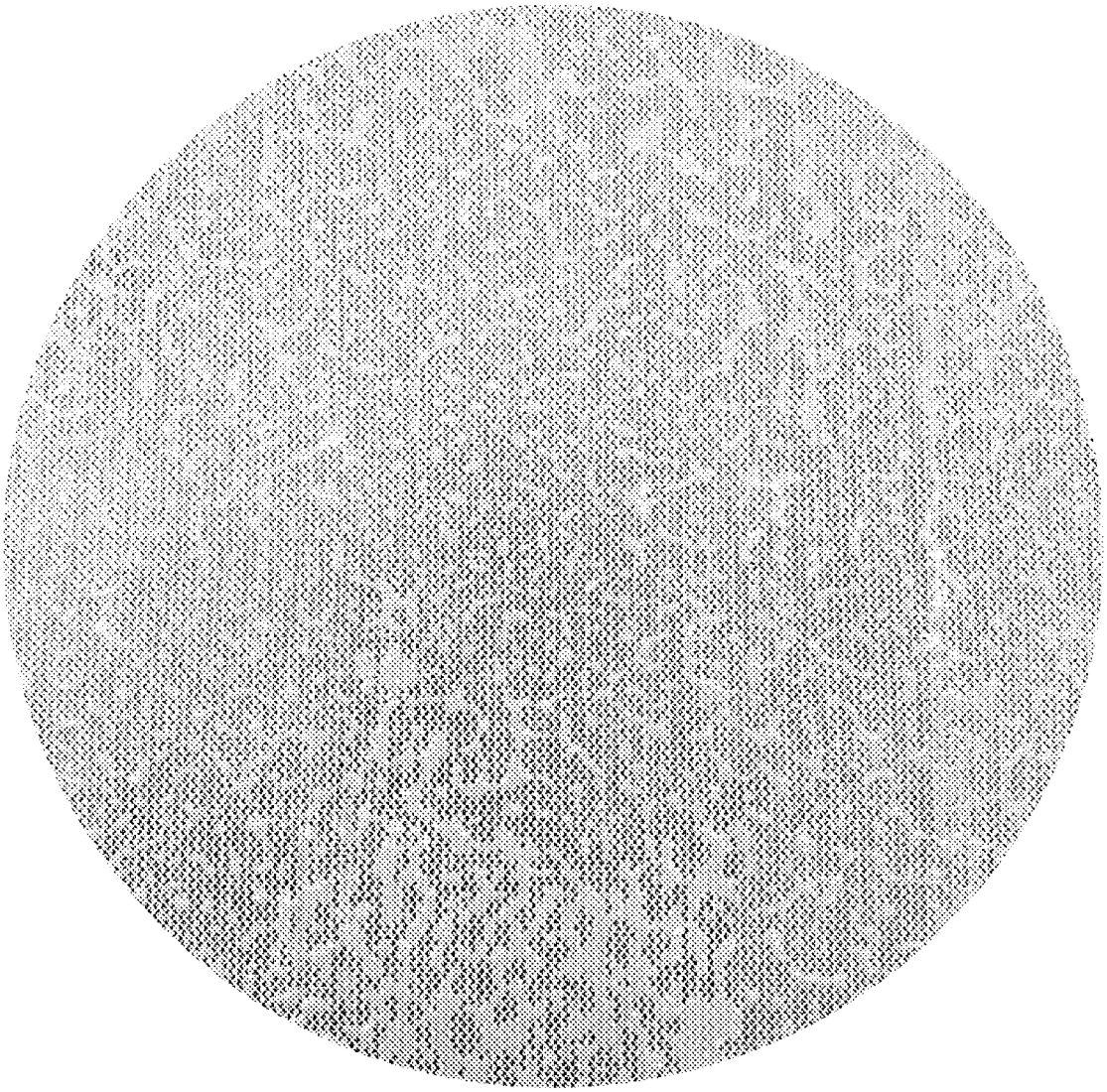
FIG. 7 is a digital photograph of top view of an abrasive article made according to embodiments of the present disclosure.

MKR1 was applied with a brush onto a 7-inch (17.8-cm) diameter disc of Laminated Substrate 1. About 4.4 g P400 grade AO abrasive mineral was applied onto the mesh backing through drop coating. The disc was pre-cured at 90° C. for 1 hour and then cured at 102° C. for 12 hours. The mesh abrasive disc having randomly distributed abrasive areas is shown in FIG. 7.

Example 2

A backing MESH with a diameter of 7 inches (17.8 cm) was placed on the hot-plate of a steam press (available as STEAMFAST Model SF-680 from Vornado air, LLC, Andover, Kansas). PET-MELTY was placed on the top of the mesh backing to fully cover the surface of the mesh backing. A pre-pattern-cut PE-MELTY (with 2 cm×2 cm square shaped opens) was placed on the top of the PET-MELTY, and the pre-pattern-cut PE-MELTY covered about 60% of the surface of PET-MELTY. The sample was pressed at 135-145° C. for about 10 seconds to laminate the laminate layer onto MESH. The sample was then cooled down to about 23° C.

Figure 8:
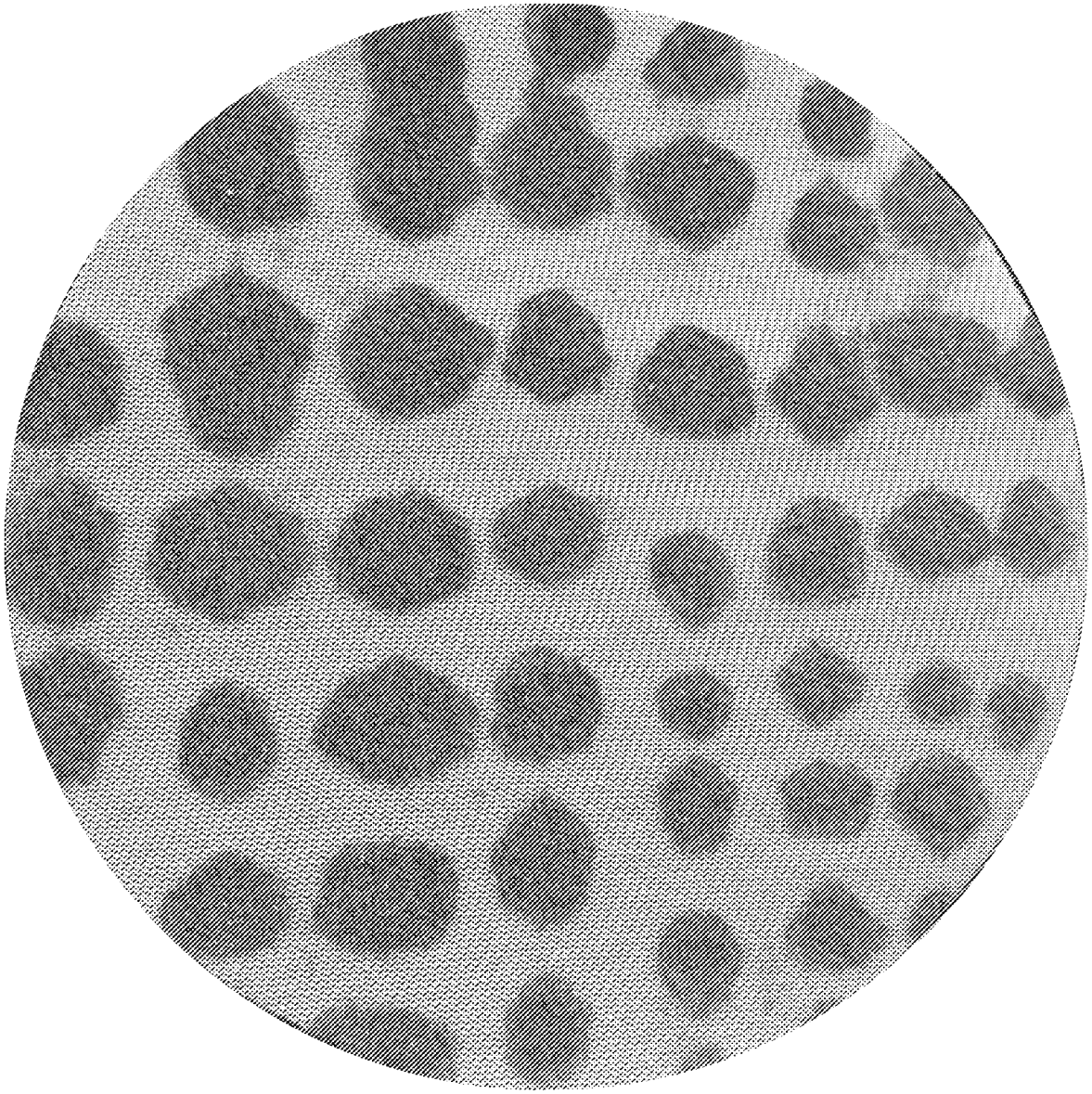
FIG. 8 is a digital micrograph top view of an abrasive article made according to embodiments of the present disclosure.

MKR2 was applied onto the mesh backing with a brush with target add-on of 1.5 grams per 50 square inches. MKR2 de-wetted on PE-MELTY portion and gathered on the PET-MELTY portion on the laminate surface, forming make resin patterns. A blend of abrasive particles comprising 15% P220 grade SAP and 85% P220 grade AO particles (total mineral weight of 5.3 grams) was applied onto the mesh backing through drop coating. A top view of the resulting coated abrasive disc with patterned abrasive layers is shown as FIG. 8.

Example 3

Figure 9:
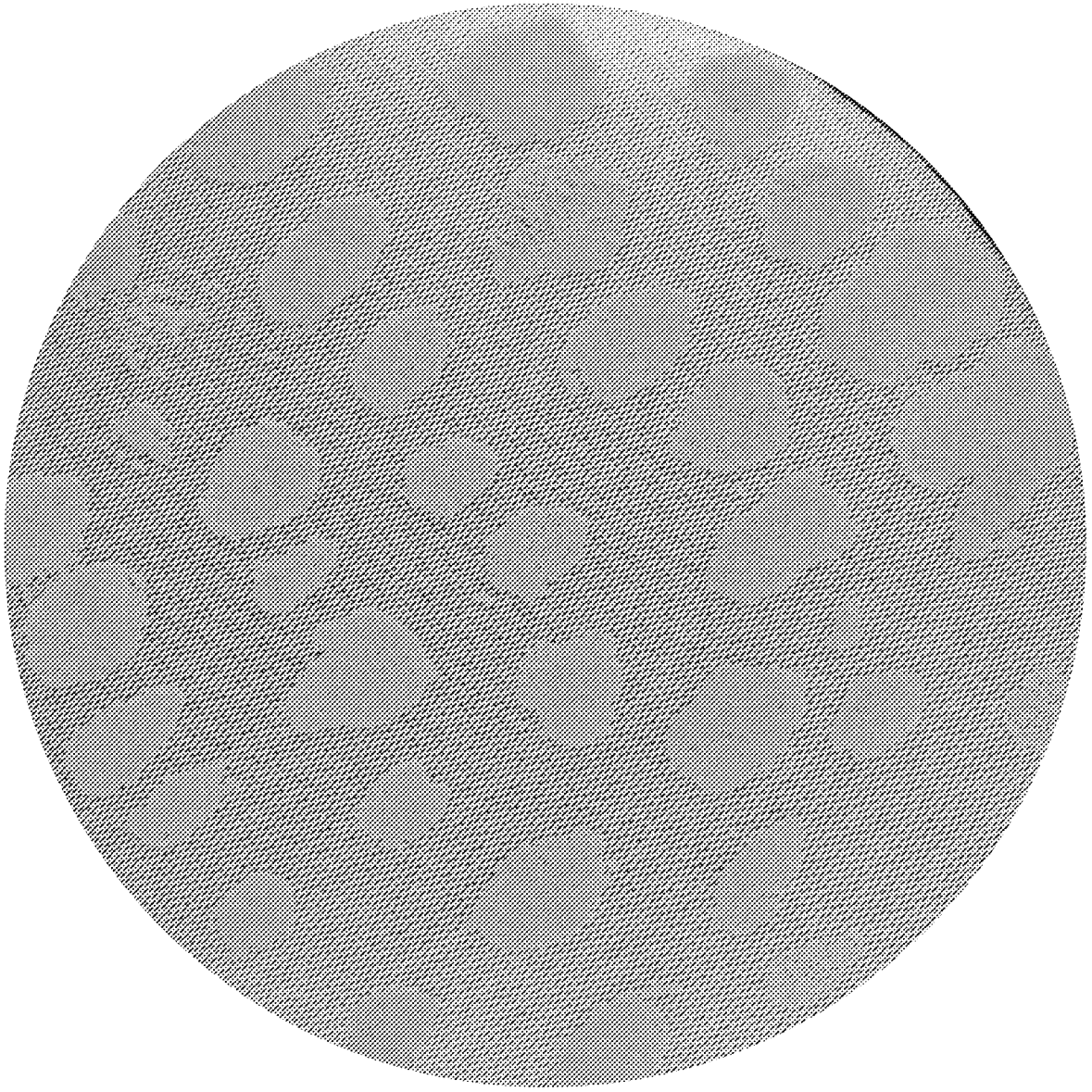
FIG. 9 is a digital photograph top view of an abrasive article made according to embodiments of the present disclosure.

The procedure described in Example 2 was generally repeated, except that 3.5-inch (8.9-cm) diameter MESH was used and 4.8 grams of 100% SAP was coated. A top view of the resulting coated abrasive disc with patterned abrasive layers is shown as FIG. 9.

All cited references, patents, and patent applications in this application are incorporated by reference in a consistent manner. In the event of inconsistencies or contradictions between portions of the incorporated references and this application, the information in this application shall control. The preceding description, given in order to enable one of ordinary skill in the art to practice the claimed disclosure, is not to be construed as limiting the scope of the disclosure, which is defined by the claims and all equivalents thereto.

What is claimed is:

1. An abrasive article comprising:

a substrate comprising strands forming first void spaces between strands;

a laminate joined to the substrate, wherein the laminate comprises a surface opposite to the substrate;

a resin composition joined to the surface of the laminate, wherein a first portion of the surface of the laminate has a first surface free energy, wherein a second portion of the surface of the laminate has a second surface free energy, and wherein the first surface free energy is different from the second surface free energy; and abrasive particles joined to the resin composition, wherein a plurality of second void spaces extends through the laminate coinciding with first void spaces in the porous substrate.

2. An abrasive article comprising:

a substrate comprising strands forming first void spaces between strands;

a laminate joined to the substrate, wherein the laminate comprises a first polymer and a second polymer;

a resin composition joined to the laminate; and abrasive particles joined to the resin composition, wherein a plurality of second void spaces extends through the laminate coinciding with first void spaces in the porous substrate, and wherein the first polymer has a first surface free energy, the second polymer has a second surface free energy, wherein the first surface free energy and the second surface free energy are different.

3. The abrasive article of claim 1, wherein the resin composition is water based adhesive.

4. The abrasive article of claim 1, wherein the difference of the first surface free energy and the second surface free energy is at least 3 millinewtons per meter at 20 degrees Celsius.

5. The abrasive article of claim 1, wherein the difference of the first surface free energy and the second surface free energy is at least 5 millinewtons per meter at 20 degrees Celsius.

6. The abrasive article of claim 1, wherein the difference of the first surface free energy and the second surface free energy is at least 8 millinewtons per meter at 20 degrees Celsius.

7. The abrasive article of claim 1, wherein the laminate at least partially wraps around the strands to leave open the first and second void spaces.

8. The abrasive article of claim 1, wherein the laminate avoids the first void spaces when cured resin composition is absent above the first void spaces.

9. The abrasive article of claim 1, wherein the laminate covers the first void spaces when the cured resin composition is above the first void spaces.

10. The abrasive article of claim 1, wherein the resin composition has a higher melting point than the laminate.

11. The abrasive article of claim 1, wherein the laminate comprises at least a hot-melt material.

12. The abrasive article of claim 1, wherein the abrasive particles comprise shaped abrasive particles.

13. The abrasive article of claim 1, wherein the first portion and the second portion are distributed randomly on the surface of the laminate.

14. The abrasive article of claim 1, wherein the first portion and the second portion array in a pattern on the surface of the laminate.

15. The abrasive article of claim 1, wherein at least one of the first portion and the second portion is a plurality of discrete areas on the surface of the laminate.

16. The abrasive article of claim 1, wherein at least one of the first portion and the second portion is an interconnected section.

17. The abrasive article of claim 1, wherein the surface of the laminate comprises a third portion having a third surface free energy, wherein the third surface free energy is different from the first and second surface free energies.

* * * * *